US009290975B2

(12) United States Patent
Dubach

(10) Patent No.: US 9,290,975 B2
(45) Date of Patent: Mar. 22, 2016

(54) MOVABLE MOUNTING PLATE FOR FURNITURE HINGES

(71) Applicant: Julius Blum GmbH, Hoechst (AT)

(72) Inventor: Fredi Dubach, Baeretwil (CH)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 14/220,317

(22) Filed: Mar. 20, 2014

(65) Prior Publication Data

US 2014/0201948 A1 Jul. 24, 2014

Related U.S. Application Data

(63) Continuation of application No. PCT/AT2012/000216, filed on Aug. 23, 2012.

(30) Foreign Application Priority Data

Sep. 21, 2011 (AT) ..... 1359/2011

(51) Int. Cl.
*E05D 3/16* (2006.01)
*E05D 7/00* (2006.01)
(Continued)

(52) U.S. Cl.
CPC .. *E05D 7/00* (2013.01); *E05D 3/06* (2013.01); *E05D 3/16* (2013.01); *E05D 3/18* (2013.01); *E05D 5/0276* (2013.01); *E05D 7/125* (2013.01); *E05Y 2600/626* (2013.01);
(Continued)

(58) Field of Classification Search
CPC ..... E05D 3/06; E05D 3/12; E05D 3/14; E05D 3/142; E05D 3/16; E05D 3/18; E05D 3/183; E05D 2003/163; E05D 2003/166; E05D 5/0276; E05D 7/12; E05D 7/123; E05D 7/125; Y10T 16/535; Y10T 16/5858; Y10T 16/5476
See application file for complete search history.

(56) References Cited

U.S. PATENT DOCUMENTS 3,952,368 A * 4/1976 Zernig et al. ..... 16/291
4,376,324 A * 3/1983 Lautenschlager et al. ..... 16/236
(Continued)

FOREIGN PATENT DOCUMENTS

AT 369 107 12/1982
BE 753028 12/1970
(Continued)

OTHER PUBLICATIONS

Chinese Search Report (SR) issued May 6, 2015 in parallel Chinese Patent Application No. 201280045969.X.
(Continued)

*Primary Examiner* — Jeffrey O'Brien
(74) *Attorney, Agent, or Firm* — Wenderoth, Lind & Ponack, L.L.P.

(57) ABSTRACT

The invention relates to a mounting device for fixing a furniture hinge, comprising a base plate, which is to be fixed to a furniture part, in particular a lateral wall of a furniture body, and comprising a fixing device for fixing the hinge to the mounting device, preferably in a removable manner. The fixing device is movably mounted on the base plate, said mounting device having a connecting element which is mounted on the base plate in a movable manner via at least one toggle lever and which can be fixed to a hinge part that can be moved during the opening and closing movement of the hinge, wherein the fixing device can be moved relative to the base plate via the toggle lever.

17 Claims, 21 Drawing Sheets

(51) Int. Cl.

| | |
|---|---|
| ***E05D 3/06*** | (2006.01) |
| ***E05D 3/18*** | (2006.01) |
| ***E05D 5/02*** | (2006.01) |
| *E05D 7/12* | (2006.01) |

(52) U.S. Cl.

CPC ..... *Y10T 16/535* (2015.01); *Y10T 16/541* (2015.01); *Y10T 16/5476* (2015.01); *Y10T 16/554* (2015.01)

(56) References Cited

U.S. PATENT DOCUMENTS

| | | | | |
|---|---|---|---|---|
| 4,584,738 | A | 4/1986 | Lautenschlager | |
| 5,033,160 | A * | 7/1991 | Salice | 16/240 |
| 5,036,565 | A | 8/1991 | Salice | |
| 5,535,482 | A | 7/1996 | Grabber | |
| 5,937,479 | A * | 8/1999 | Ohshima et al. | 16/257 |
| 8,226,183 | B2 | 7/2012 | Kang et al. | |
| 2002/0046441 | A1 | 4/2002 | Brustle | |
| 2007/0251058 | A1 * | 11/2007 | Fitz et al. | 16/287 |
| 2010/0231111 | A1 | 9/2010 | Kang et al. | |

FOREIGN PATENT DOCUMENTS

| | | |
|---|---|---|
| CN | 201176771 | 1/2009 |
| CN | 201526218 | 7/2010 |
| DE | 34 07 174 | 8/1985 |
| DE | 43 18 607 | 12/1994 |
| DE | 201 21 164 | 5/2002 |
| EP | 0 398 192 | 11/1990 |
| EP | 0 398 193 | 11/1990 |
| EP | 0 791 710 | 8/1997 |
| GB | 2 070 129 | 9/1981 |
| JP | 2005-139765 | 6/2005 |
| WO | 2006/053364 | 5/2006 |
| WO | 2008/130124 | 10/2008 |
| WO | 2010/105281 | 9/2010 |

OTHER PUBLICATIONS

International Search Report (ISR) issued Dec. 4, 2012 in International (PCT) Application No. PCT/AT2012/000216.

Austrian Search Report (ASR) issued May 22, 2012 in Austrian Patent Application No. A 1359/2011.

* cited by examiner

MOVABLE MOUNTING PLATE FOR FURNITURE HINGES

BACKGROUND OF THE INVENTION

The invention concerns a mounting device for fixing a furniture hinge including a base plate to be fixed to a furniture part, in particular a side wall of a furniture carcass. A fixing device is provided for preferably releasably fixing the hinge to the mounting device, wherein the fixing device is mounted moveably on the base plate.

In the pivotal movement of furniture parts connected pivotably relative to each other by a hinge from the closed position into the open position there is basically the risk that collisions with adjacent furniture parts can occur. That involves in particular furniture doors which are pivotable by the hinge and which serve for closing off a furniture carcass and which can collide with adjacent furniture doors or other projecting furniture parts upon being opened or closed.

To resolve that problem, AT 369 107 discloses an especially constructed wide-angle hinge with which it is possible to achieve a lifting-away movement for pivoting the door from the end edge of the furniture carcass, during the opening movement of the furniture door. In that case, fixed to the furniture carcass is a mounting housing having two slots which are disposed one behind the other and in which pins connected to the hinge arm are moveably mounted, whereby the hinge arm is guided displaceably and partially pivotably. In that situation, a gear meshing with two toothed racks which are moveable relative to each other serves to drive the hinge arm whereby the latter moves relative to the mounting housing which is fixed to the furniture carcass and a greater opening movement of the furniture door is achieved.

DE 43 18 607 also discloses a wide-angle hinge in which the door is pivoted away from the furniture carcass during the opening movement to avoid collisions with adjacent furniture doors. Once again, arranged in a mounting housing fixed to the furniture carcass are a plurality of slots in which pins connected to the hinge arm are displaceably mounted. To drive the hinge arm, a pulling means is fixed in the hinge cup, the pulling means being held in a constantly stressed condition.

The above-mentioned hinges suffer from the disadvantage of a complicated structure which is thus susceptible to faults. As these hinges are not necessary for all furniture doors, the complication and expenditure involved in the production of those kind of hinges is excessively high.

Another possible way of achieving an increased opening movement is disclosed in WO 2006/053364. The hinge described there has an intermediate portion between the hinge cup and the hinge arm. The intermediate portion is positively coupled to the hinge arm by two levers, and the levers are rotatably mounted both to the intermediate portion and also to the hinge arm by suitable spindles. The intermediate portion which is moveable relative to the hinge arm provides that the furniture door has an increased motion component in a direction out of the furniture carcass.

DE 34 07 174 C2 also discloses a cross-link hinge with an increased opening movement, which is made possible by a two-part hinge arm. A lower part of the hinge arm is fixedly secured to a mounting plate on the furniture carcass. Arranged on the moveably mounted upper part of the hinge arm is a hinge lever having a gear segment meshing with a toothed bar on the lower part. The hinge lever is connected to a hinge arm of the cross-link hinge, thereby permitting motional coupling of the hinge arm and the upper part. Besides the disadvantage that the increased opening stroke movement is made possible only for cross-link hinges, the hinge arm has to be connected to the base plate in a complicated structure with a complex fixing device, thereby involving a particularly high level of assembly complication and expenditure. In addition, that device has the disadvantage that further moveably mounted small parts are added to the parts which are already present in the hinge and which are moveable relative to each other, thereby increasing the complexity and susceptibility to defect of the hinge.

The disadvantage of these types of hinge is that they are in turn designed only for a specific purpose of use, thereby giving a high level of complication and expenditure both for the hinge manufacturer and also for the assembly fitter who must always have all possible types of hinge available to him.

However, a device which is independent of the hinge and with which the problem of collisions can be resolved in the case of an excessively small opening movement is desirable, in which respect the device can be used with a large number of the commercially available hinges.

On the other hand the extent of the increase in the opening movement, that is linked to that hinge, may still be too slight for many uses. For that situation it would be necessary to provide a device which permits an additional increase in the opening movement.

SUMMARY OF THE INVENTION

Therefore, the object of the invention is to provide such a device with which the above disadvantages are avoided and which provides a solution to the collision problems in the case of furniture parts which are pivotable by means of hinges, as independently of the hinge itself as possible.

A mounting device to which furniture hinges are fixed serves to attain that object. The mounting device itself has a base plate which is to be fixed to a furniture part for example by screws or other fixing means. In particular, the base plate is to be fixed to a side wall of a furniture carcass, in which case the furniture hinge serves for opening and closing of a furniture door.

The mounting device further includes a fixing device, by way of which the hinge is fixed to the mounting device. Preferably, a releasable fixing of the hinge permits simple fitment and removal of the hinge when the mounting device is already fixed in place. The hinge is fixed with a fitment portion to the mounting device. That fitment portion can be, for example, the hinge arm of the hinge.

The fixing device itself is mounted moveably to the base plate whereby a hinge fixed to the fixing device is also mounted moveably to the base plate.

The mounting device further includes a connecting element mounted moveably to the base plate, wherein that connecting element is moveable by way of at least one hinge lever. Besides the fixing device, the connecting element also serves for connecting the hinge to the mounting device. For that purpose, the connecting element can be fixed to a part which is moveable in the opening and closing movement of the hinge. By virtue of the fact that, in the condition of being connected to the hinge, the connecting element is fixed to a part of the hinge that is moved in the opening and closing movement of the hinge, and also moves during that movement with the moveable part of the hinge, the movements of the connecting element and the moveable part of the hinge to which the connecting element can be fixed are coupled.

Insofar as it is now provided that the fixing device is moveable relative to the base plate by way of the hinge lever so that the connecting element is mounted moveably to the base plate, the movement of the connecting element that is coupled to the movement of the hinge can be transmitted to the fixing device. The extent and the direction of the movement of the fixing device are dependent on the movement of the connecting element which controls the movement of the fixing device.

In the mounted condition of the hinge, the hinge is moved by the mobility of the fixing device together with the fixing device relative to the base plate, the movement being guided and controlled by the connecting element. If accordingly during the opening stroke movement of the fitted hinge, the part moveable on the hinge moves outwardly in the furniture carcass, the coupling effect means that the fixing device and therewith the hinge fixed to the fixing device are also moved outwardly whereby the opening stroke movement of the hinge is increased. In that case, the at least one hinge lever affords a structurally simple method of coupling and guiding the movement, without complicated pulling devices which are susceptible to defects or pin arrangements which are guided in slots.

Because the mounting device and the hinge to be fixed to the mounting device are separate components, the increased opening stroke movement is achieved independently of the hinge, by the mounting device. If a hinge is used which itself already has an increased opening stroke movement, those increases in the opening movements are added together and provide overall an even greater opening movement. The mounting device according to the invention, however, can also be used in relation to commercial hinges without an increased opening movement, whereby the increase in the opening stroke movement is effected by the mounting device and independently of the hinge itself.

Insofar as that increase in the opening stroke movement is to be attributed to the mobility of the fixing device relative to the base plate, large parts of commercial hinges can be connected to such a fixing device insofar as the latter is designed for fixing such hinges. Depending on the respectively prevailing factors in respect of the furniture parts to be pivoted, the mounting fitter can then decide whether he uses a commercial non-moveable mounting device or a mounting device according to the invention with the moveable fixing device. It is possible, however, in both cases to use the same type of hinge, whereby both the manufacturing complication and expenditure and also the mounting complication and expenditure are reduced.

In a preferred embodiment of the invention, the connecting element can be fixed to an outside, preferably to the top side, of the moveable part of the hinge. That permits particularly simple mounting and a lever arm which is as large as possible for the hinge lever, by way of which the connecting element is moveable. After the hinge is fitted on the fixing device, for example with the hinge arm, the connecting element is connected to the outside of the moveable hinge part, whereby coupling between the connecting element and the fixing device is implemented in a simple manner by way of the hinge lever. In general, the fixing device is arranged at the underside of the hinge so that the lever arm of the hinge lever amounts to the spacing between the top side of the moveable part of the hinge and the underside of the hinge if the connecting lever is fixed to the top side of the moveable part of the hinge, as is preferred.

In an embodiment of the invention, the fixing device which is moveable relative to the base plate by way of the hinge lever is moved relative to the base plate with a linear component when the hinge is opened or closed in the mounted condition. By virtue of a linear component, the fixing device can be moved outwardly for example in a furniture carcass, during the opening movement of the furniture door, with a linear motion component whereby the spacing of the furniture door relative to the closing edge of the furniture carcass is increased. In the reversed closing movement, that spacing is reduced by a linear movement of the fixing device into the interior of the furniture carcass.

In a preferred embodiment of the invention, the hinge arm can be clipped on to the fixing device. For that purpose, the fixing device has latching elements which are known in the state of the art and which can engage into holding elements or arresting elements corresponding thereto on the hinge arm, thereby affording a snap-action connection. A hinge which can be clipped on permits particularly simple fixing of the hinge to the mounting device. The latching or arresting elements can be resilient or spring-loaded. Preferably disposed in the hinge is a release device with which the snap-action connection can be released again so that the hinge can be easily removed from the mounting device. A release button with which the connection to a latching element can be released serves for example as the release device. For that purpose, the arresting element can be partially rotated about an axis with the release button. Releasable snap-action connections of that kind for fixing hinges to mounting plates are known in the state of the art.

In an embodiment of the invention, the connecting element can be clipped to the moveable part of the hinge. For that purpose, the hinge or the connecting element has latching elements which engage into arresting elements corresponding thereto on the respective other part and permit those parts to be connected. Once again, the latching elements and/or the arresting elements can be resilient or spring-loaded and there can be a release device. It can however also be provided that the connecting element is screwed to the moveable part of the hinge or fixed in some other fashion.

In an embodiment of the invention, the connecting element has a plate-shaped or a profile-shaped part or is at least in part of a plate-shaped or profile-shaped configuration to bear against the moveable part of the hinge in areal relationship. The profile-shaped part can at least partially embrace the moveable part of the hinge. That permits an efficient and simple way of fixing the connecting element. At the same time, the hinge movement can be transmitted uniformly to the connecting element.

In a further embodiment, the fixing device is substantially plate-shaped. Deviations from the plate shape are afforded for example by mounting lugs for moveably mounting the hinge lever, by way of which the connecting element is coupled to the fixing device, or the latching or arresting elements for fixing the hinge. The fixing device however can also have a receiving plate to which a fitment portion of the hinge can be fixed. The receiving plate can also be part of the fixing device which has a substantially plate-shaped configuration. In the case of fixing the hinge arm, the receiving plate preferably has an elongate shape adapted to the shape of the hinge arm.

In a preferred embodiment of the invention, the connecting element is in the form of a lever. Preferably in that respect, there is provided a two-part lever, thereby affording desirable kinematic relationships in conjunction with the hinge lever, by way of which the connecting element is connected to the fixing device.

In an embodiment, the fixing device is hingedly connected to the at least one hinge lever. For that purpose, there can be a mounting lug for the at least one hinge lever, with the hinge lever being mounted rotatably to the mounting lug. The connecting element is mounted pivotably relative to the fixing device by way of the hinge lever.

For moveably mounting the hinge lever to the base plate, a mounting lug to which the hinge lever is rotatably mounted can be provided.

A further method of moveably mounting the at least one hinge lever to the base plate involves a gear or a gear segment, by which the hinge lever is mounted rotatably to the base plate. In that case, the hinge lever is mounted both rotationally and also moveably with a translatory movement by way of the gear or the gear segment.

As a counterpart to the gear or gear segment arranged on the base plate, at least one toothed bar meshes with the gear or the gear segment, and also serves for moveably mounting the hinge lever to the base plate.

At least one further hinge lever can be provided for moveably mounting the fixing device to the base plate. Additionally or alternatively, a guide device can be arranged on the base plate, by which the movement of the fixing device is guided relative to the base plate.

For hinges in which the hinge arm is moved during the opening and closing movement in the mounted condition of the hinge, the mounting device can have such a configuration that the connecting element can be fixed to the hinge arm.

In addition, hinges are known in the state of the art, in which there is an intermediate portion which is mounted moveably on the hinge arm and which is preferably coupled to the hinge arm by at least two levers. In the mounted condition of the hinge, that intermediate portion is moved relative to the hinge arm which is fixedly joined to the furniture carcass. In that case, the mounting device has such a design that the connecting element can be connected to that intermediate portion which represents the moveable part of the hinge.

For that purpose, the dimensions of the at least one hinge lever and the connecting element are adapted to the dimensions of the hinge arm or to the dimensions and the arrangement of the intermediate portion mounted moveably to the hinge arm.

The invention also concerns an arrangement having a hinge, in particular a wide-angle hinge, and a mounting device as described above.

In an embodiment, the hinge has a hinge arm fixable to the fixing device. In addition, an intermediate portion can be mounted to the hinge arm and is preferably coupled to the hinge arm by at least two levers. In that case, the connecting element can be fixed to the intermediate portion.

The invention further concerns an article of furniture comprising a furniture carcass and a furniture door mounted moveably to the furniture carcass. A mounting device as described above is mounted to the furniture carcass, and a hinge, preferably a wide-angle hinge, for opening and closing the furniture door, is fixed to the mounting device.

BRIEF DESCRIPTION OF THE DRAWINGS

Further details and advantages of the present invention are described more fully hereinafter by the specific description with reference to the drawings, in which.

DETAILED DESCRIPTION OF THE INVENTION

Figure 1A:
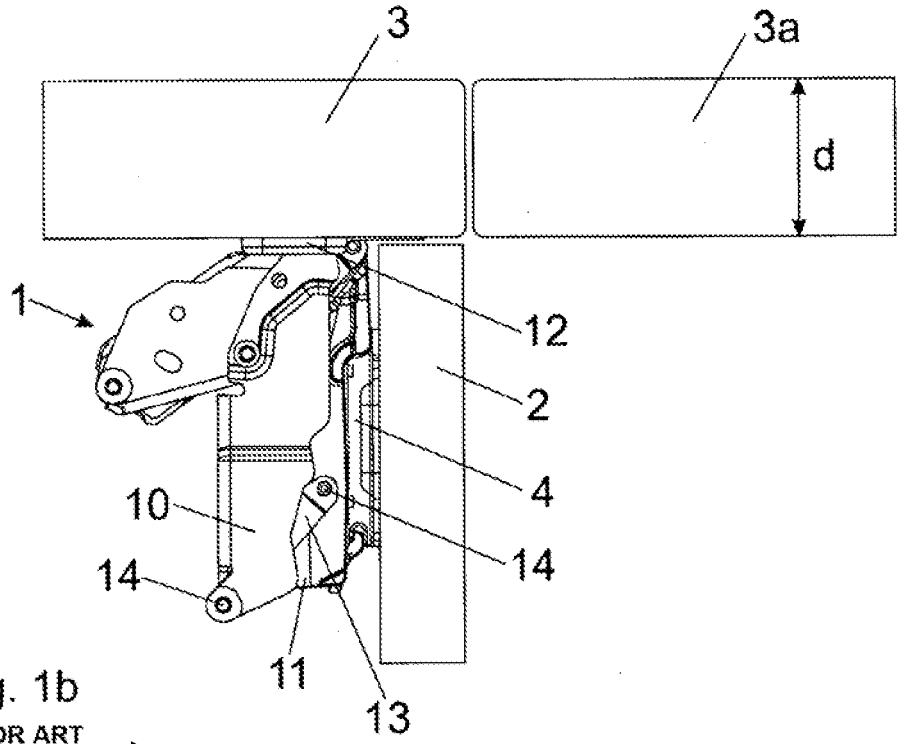
Fig. 1a PRIOR ART
FIGS. 1*a* through 1*d* are plan views of a mounting device known in the state of the art with a fixed hinge in various open positions.

FIG. 1*a* shows a plan view of a mounting plate 4 in the state of the art, mounted to a side wall 2 of a furniture carcass. Fixed to the mounting plate 4 is a wide-angle hinge 1, by which a furniture door 3 can be opened and closed. Like the adjacent furniture door 3*a* the furniture door 3 is of a great thickness d. The hinge 1 is in the end position defined by the closed condition.

In this case the wide-angle hinge 1 is fixed to the mounting plate 4 with a first fitment portion—here the hinge arm 11. With the second fitment portion—here the hinge cup 12—the hinge is fixed to two pivotably mounted furniture doors 3, relative to the side wall.

The intermediate portion 10 is moveable relative to the hinge arm 11 by two hinge arm levers 13 and is positively coupled to the hinge arm 11 by the levers 13, wherein the levers 13 are mounted rotatably both on the intermediate portion 10 and also on the hinge arm by way of suitable spindles 14. By that intermediate portion 10, it is possible for the furniture parts 2 and 3 not only to be pivoted relative to each other but also for their spacing from each other to be increased in the pivotal movement, that is to say to afford an increased opening stroke movement. For that purpose, the intermediate portion 10 is pivoted by the levers 13 at the first end position shown in FIG. 1*a* beyond the hinge arm 11 and prolongs same to the end position shown in FIG. 1*d*, defined by the completely open position. That means that the two fitment portions 11 and 12 are moved away from each other to differing degrees in the two end positions. A hinge very similar to that hinge 1, with the same functional principle, is disclosed in WO 2006/053364.

Figure 1B:
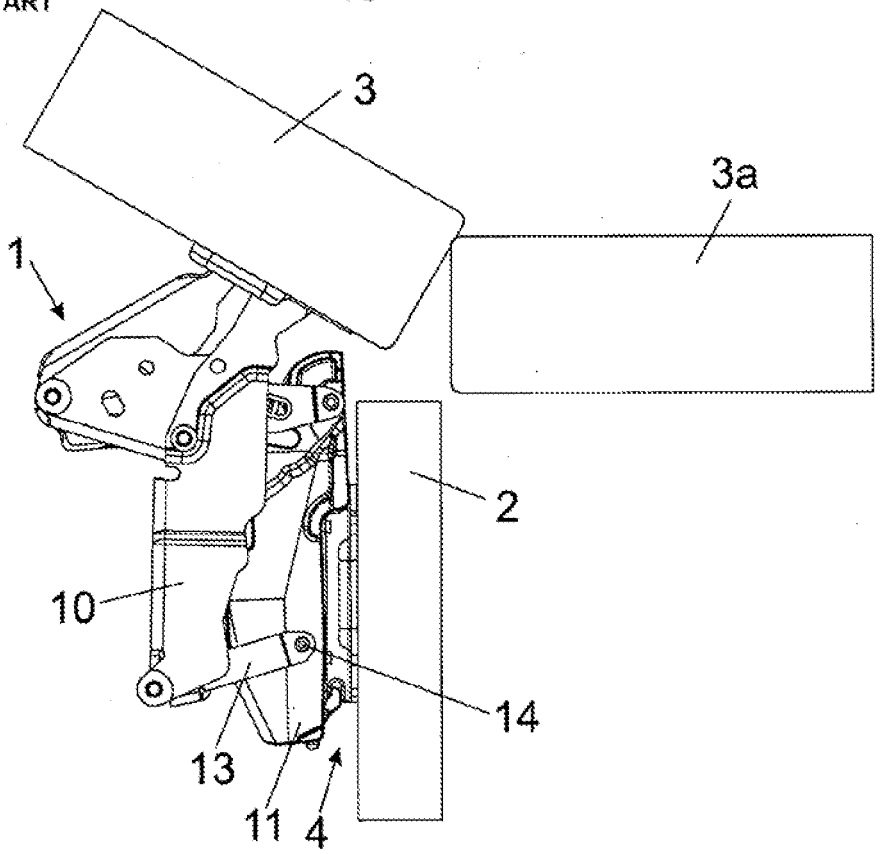
Fig. 1b PRIOR ART
Figure 1C:
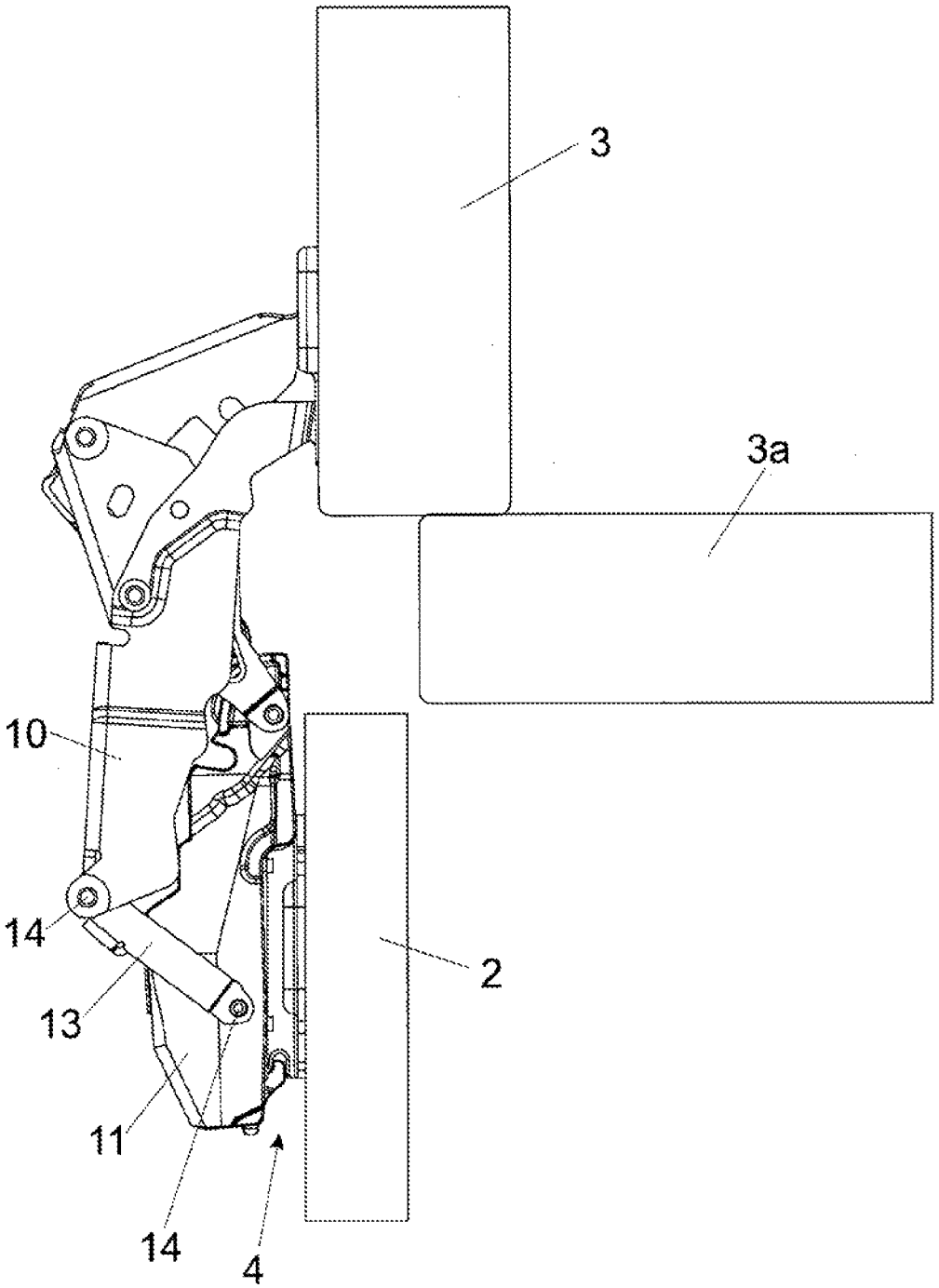
Fig. 1c PRIOR ART
Figure 1D:
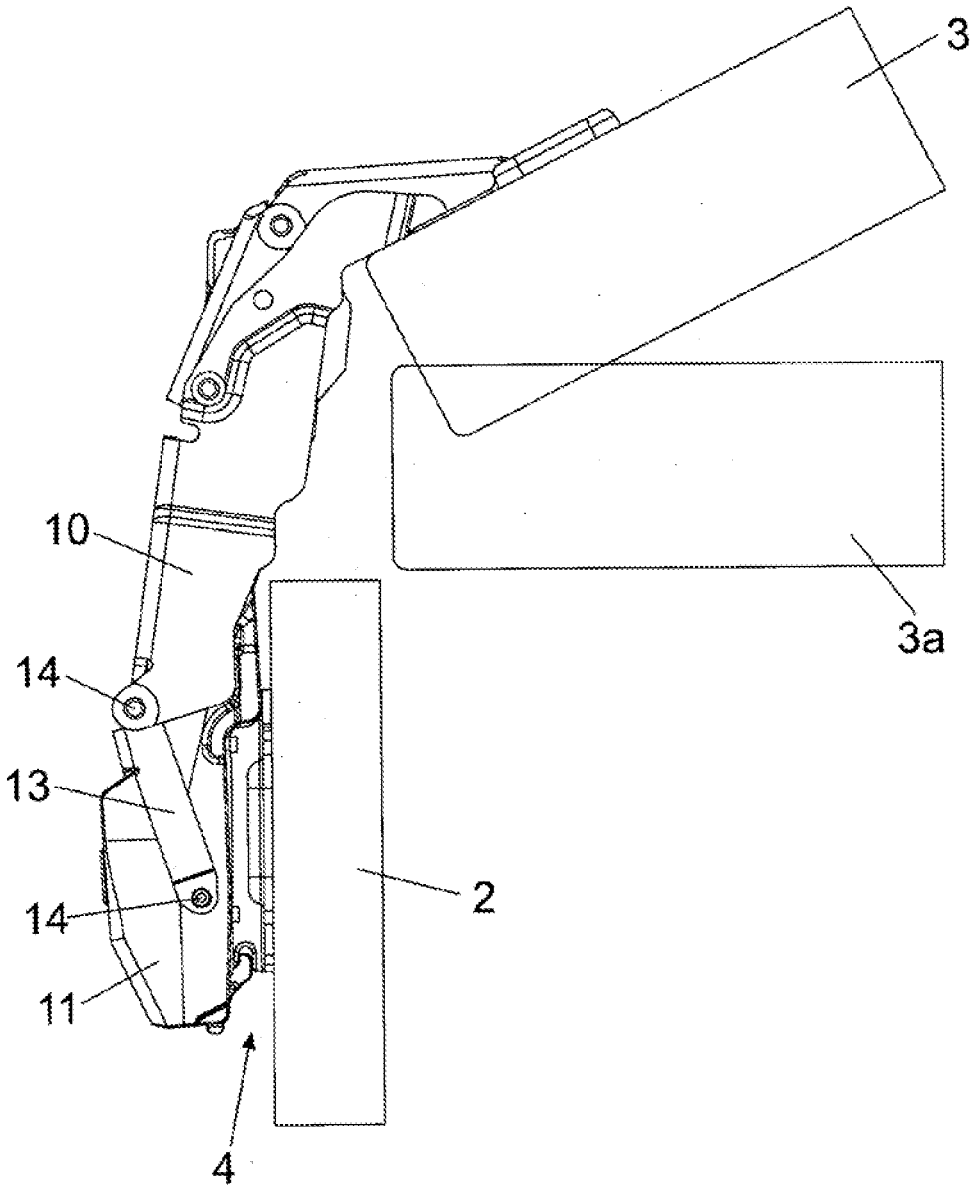
Fig. 1d PRIOR ART

As can be seen from FIGS. 1*b* and 1*d*, the thickness d however is so great that, in spite of the increased opening stroke movement of the hinge 1, a collision occurs between the adjacent furniture doors 3 and 3*a*. If there were a wish to even further increase the opening stroke movement, the proportions of the hinge would have to be markedly increased, whereby valuable space inside the furniture carcass is lost.

FIGS. 1*a*, 1*b*, 1*c* and 1*d* represent the time sequence of the opening movement of the hinge 1 with fixed furniture door 3. As a consequence of the collision diagrammatically shown in FIG. 1*d* between the furniture doors 3 and 3*a*, the theoretically possible maximum opening angle of about 170° of the hinge 1 cannot be reached.

Figure 2A:
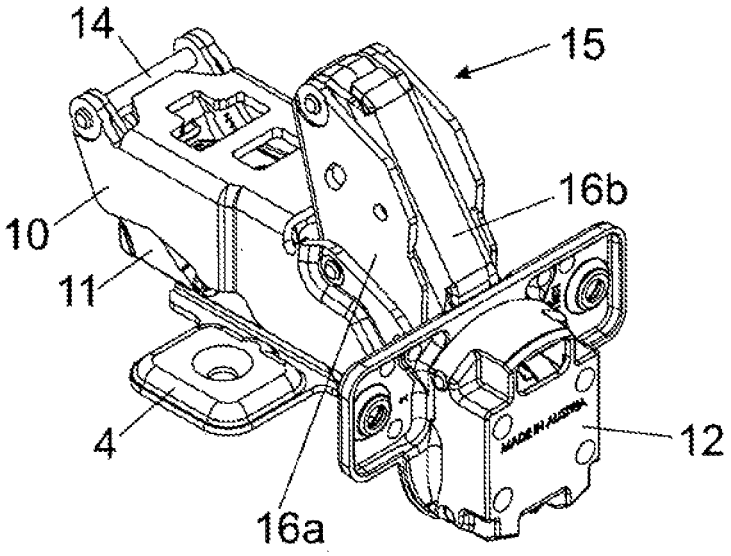
Fig. 2a PRIOR ART
FIGS. 2*a* through 2*c* are perspective views of a hinge fixed to a mounting device according to the state of the art in two different open positions and a separate view of those components.

FIG. 2*a* shows a perspective view of the hinge 1 in the condition of being connected to the mounting plate 4 of the state of the art. The hinge 1 is in the closed position. The limbs 16*a* and 16*b* of the hinge cup lever 15 of the hinge are in the completely folded-together condition.

Figure 2B:
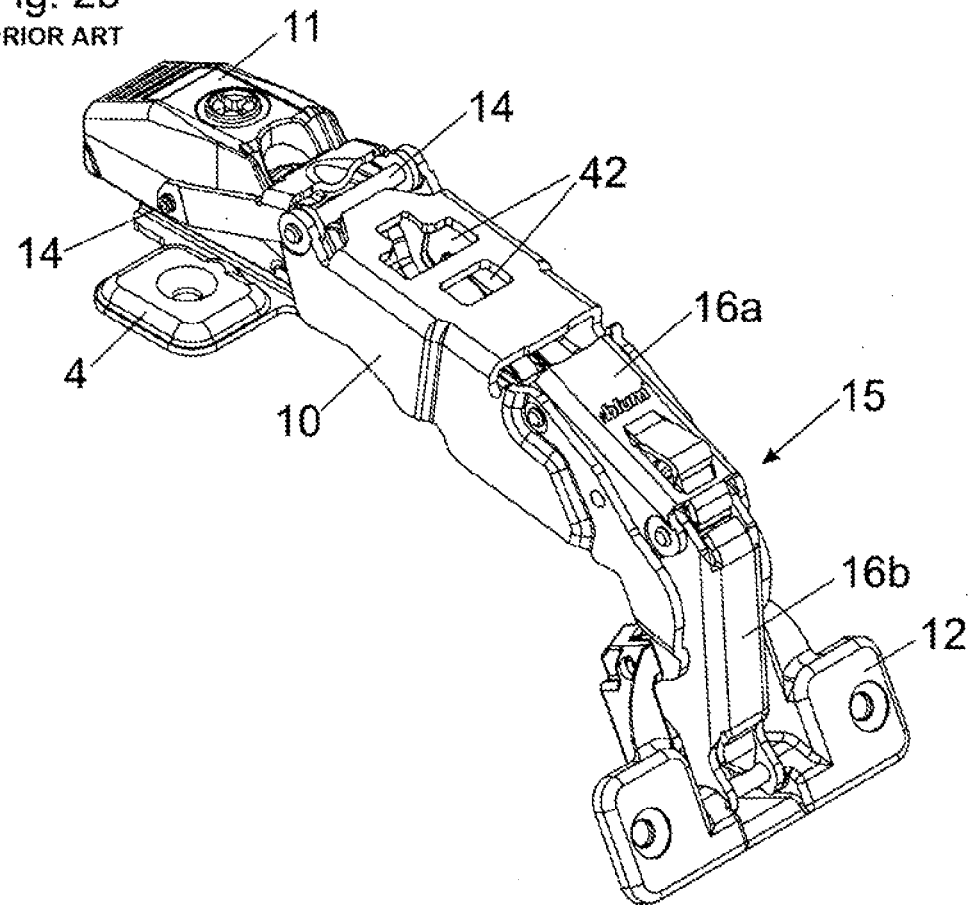
Fig. 2b PRIOR ART

FIG. 2*b* shows a perspective view of the hinge 1 in the second end position in which the hinge 1 is completely open. The limbs 16*a* and 16*b* of the hinge cup lever 15 are completely pivoted away from each other. The intermediate portion 10 is also in the end position defined by the hinge lever 13, relative to the hinge arm 11, whereby the maximum opening stroke movement is achieved.

Figure 2C:
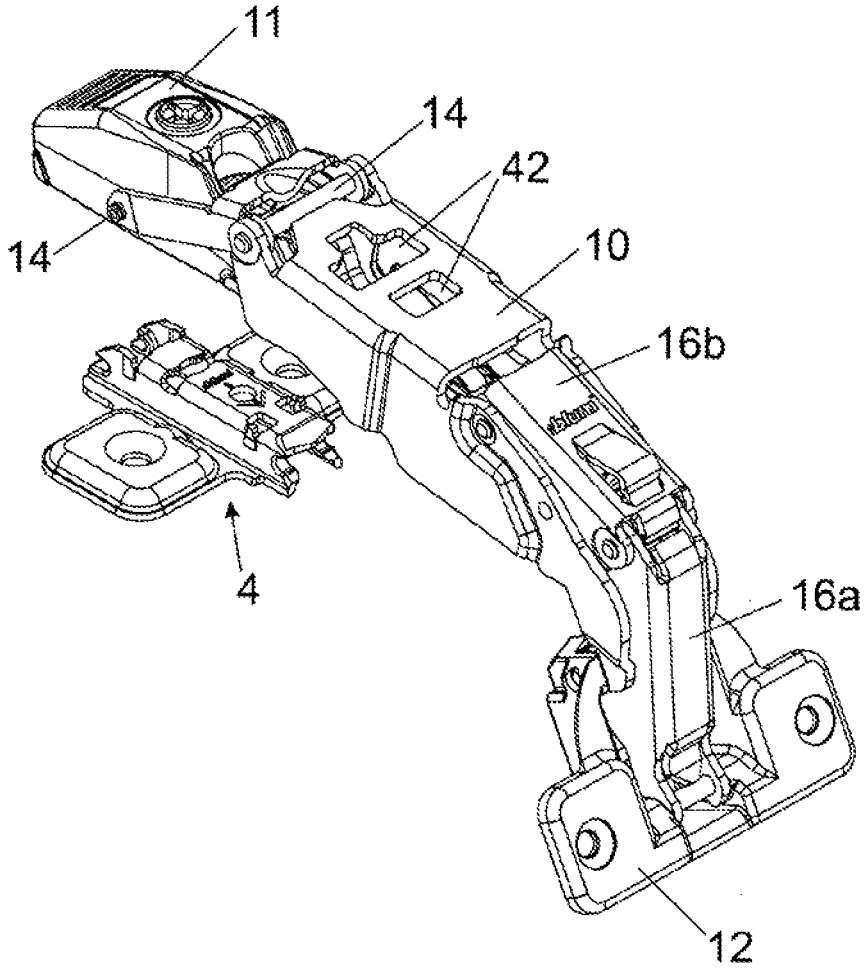
Fig. 2c PRIOR ART

FIG. 2*c* shows the view of FIG. 2*b* with the mounting plate 4 of the state of the art, separate from the hinge. In this case, the mounting plate 4 is of such a design configuration that the hinge arm 11 can be easily clipped on to the mounting plate 4, thereby providing a snap-action connection. The mounting plate 4 itself is fixed to the furniture carcass with screws.

Figure 3A:
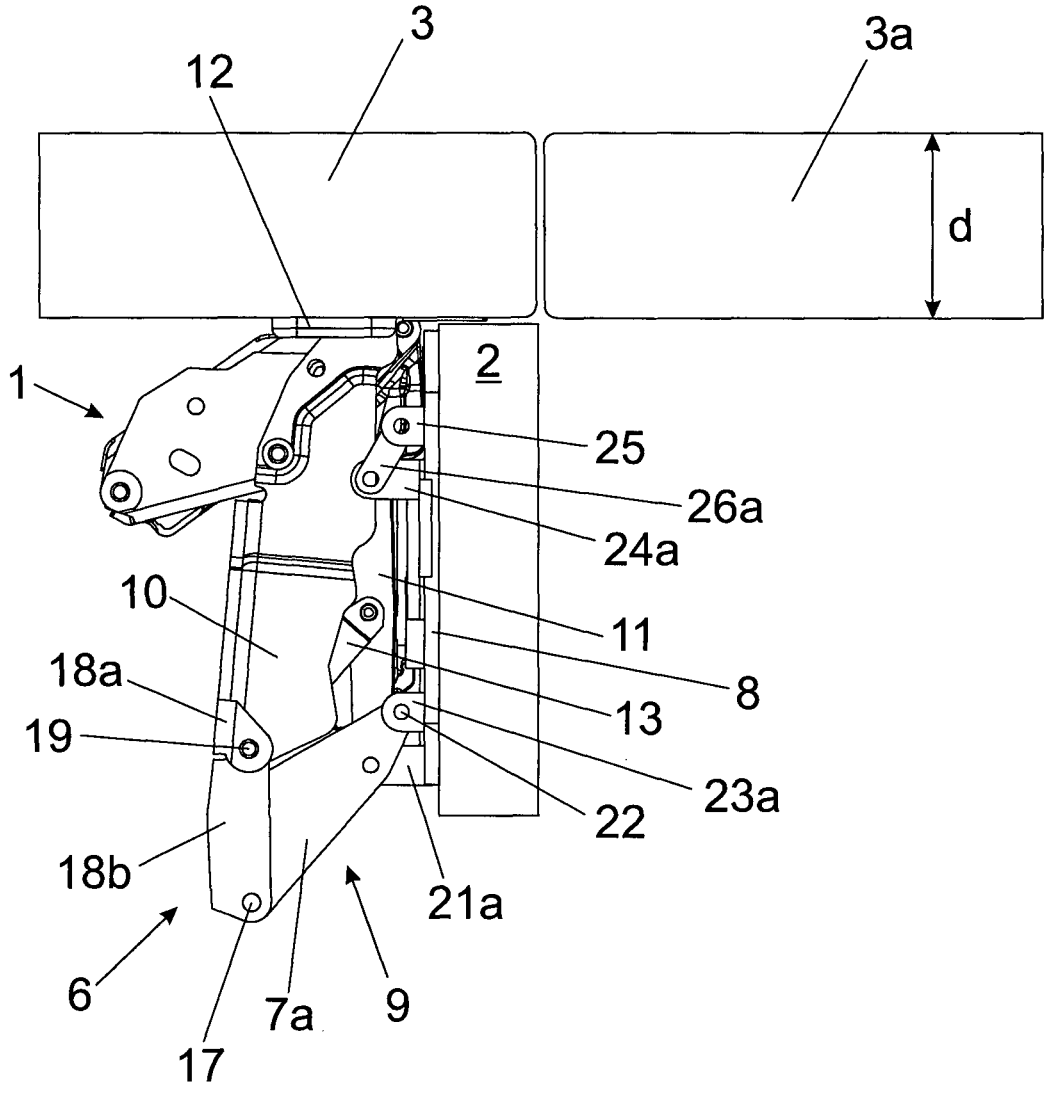
FIGS. 3*a* through 3*d* are plan views of a first embodiment of the mounting device according to the invention with fixed wide-angle hinge in various open positions.
Figure 3B:
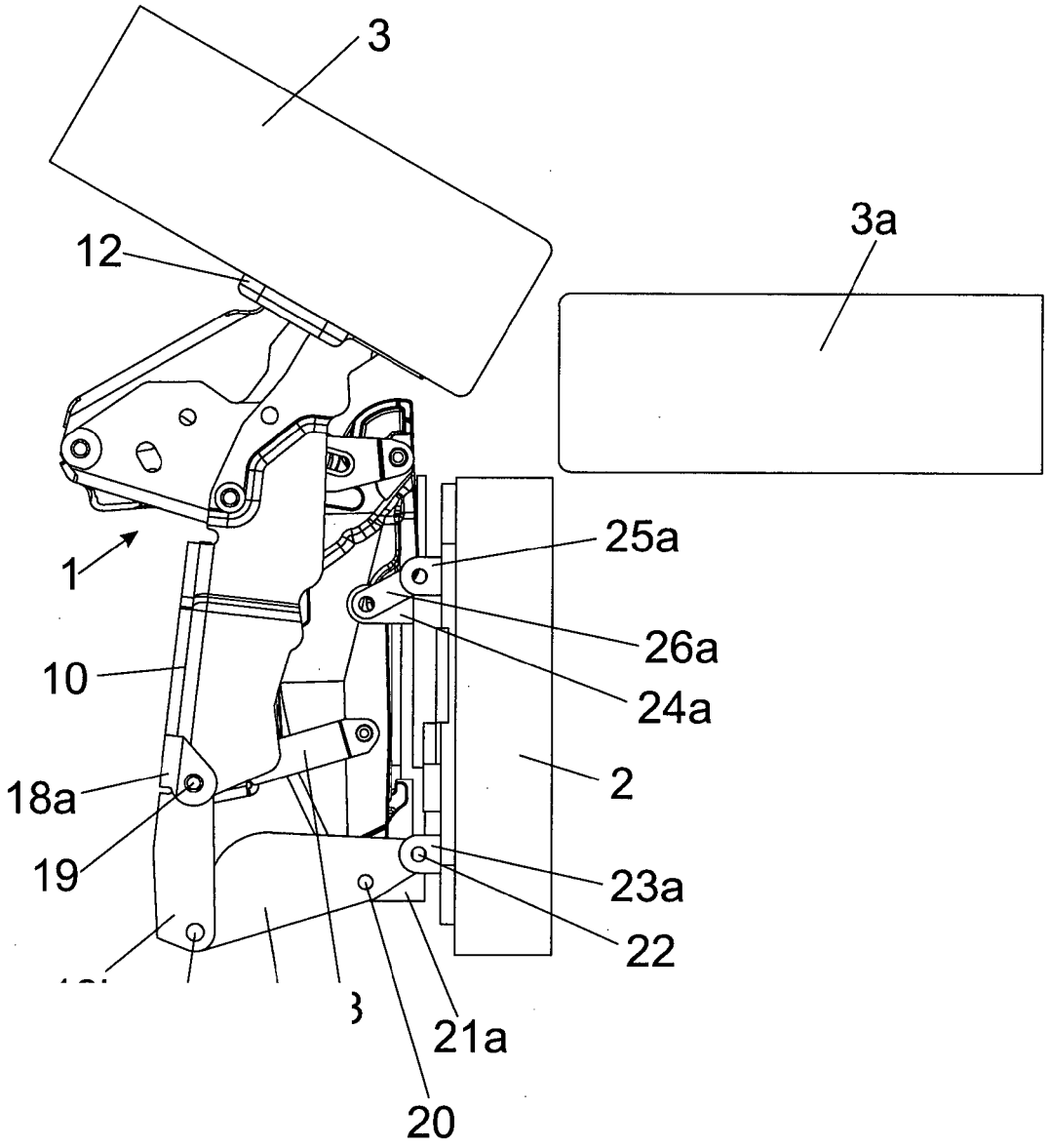
Figure 3C:
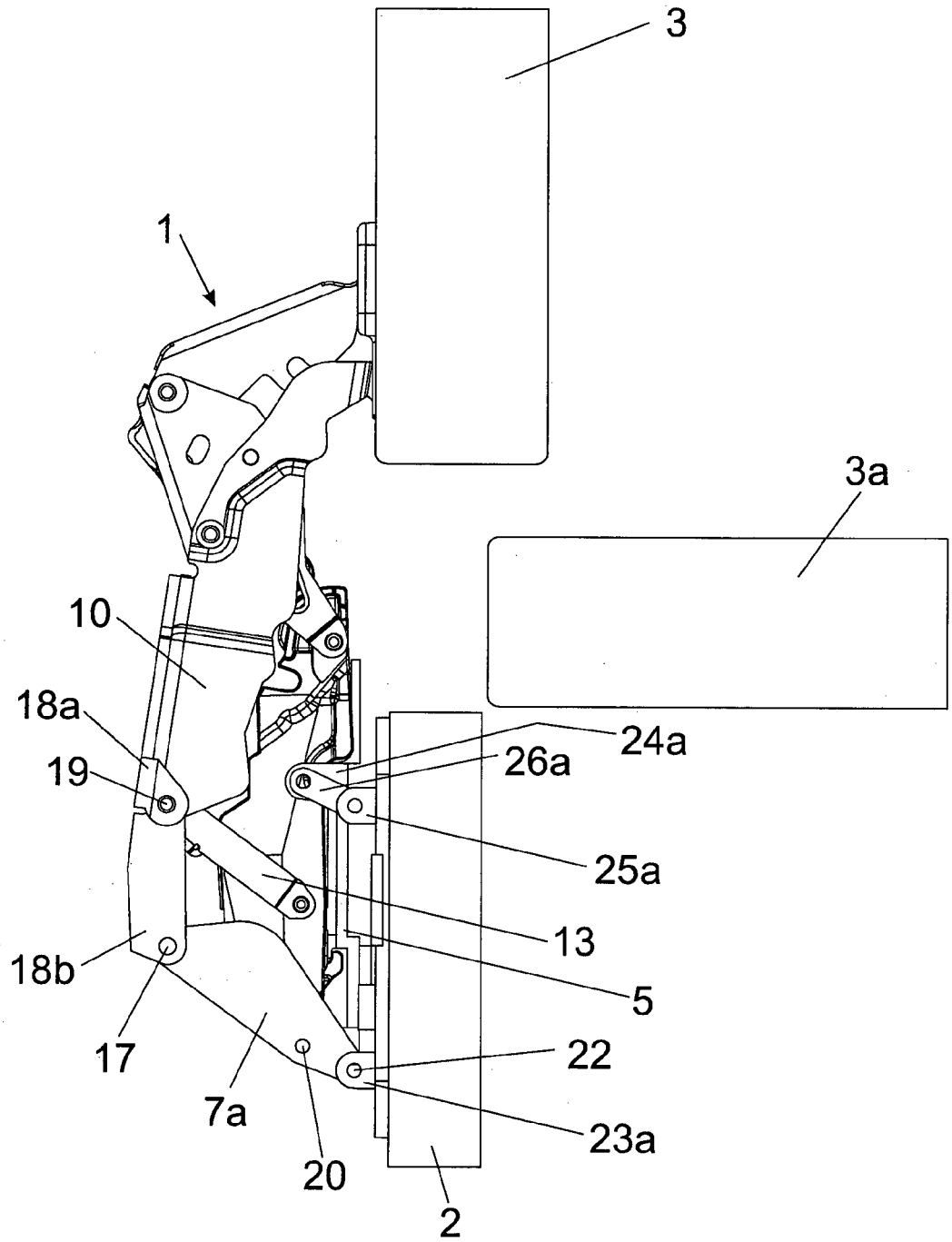
Figure 3D:
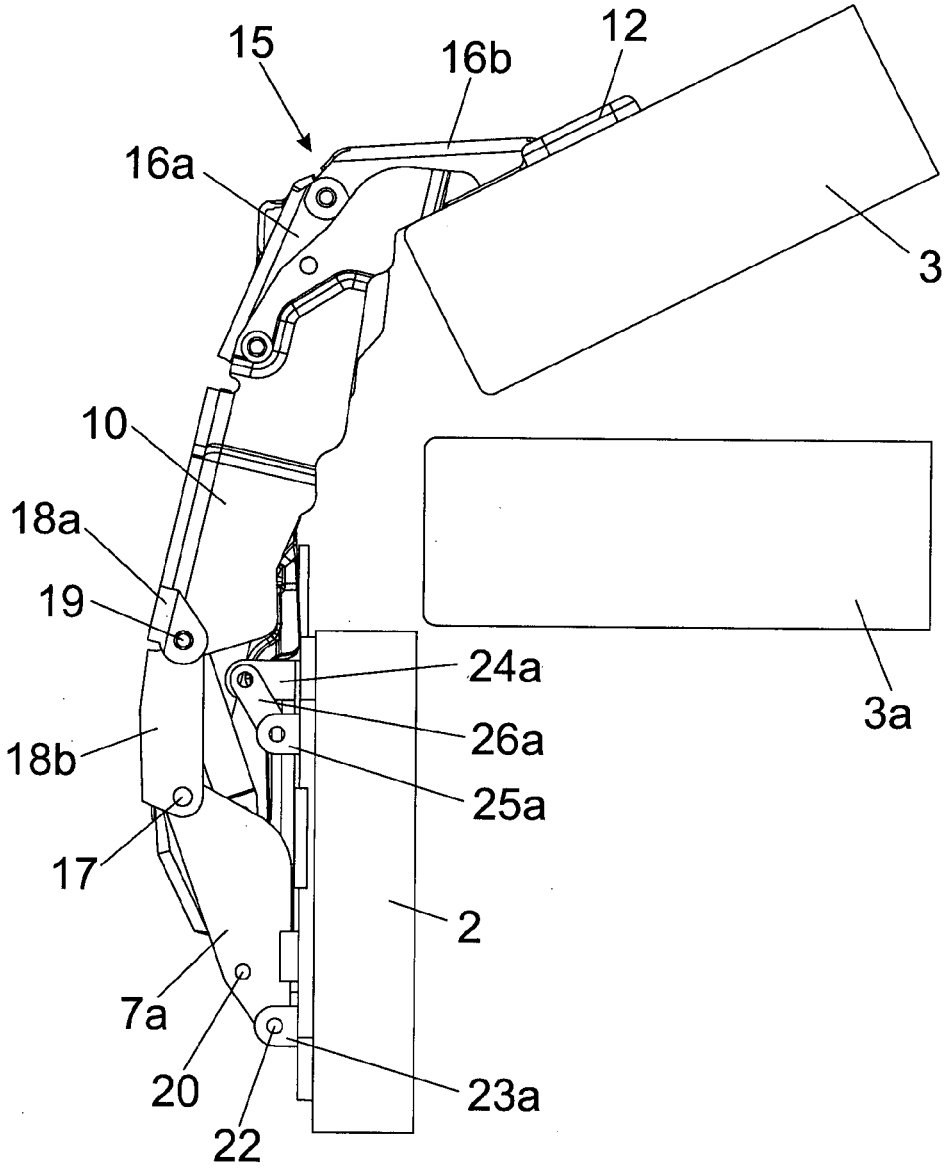

FIG. 3*a* shows a plan view of a hinge 1 which substantially corresponds to the hinge 1 in FIGS. 1 and 2. The hinge 1 is again fixed with a hinge cup 12 to a furniture door 3 and to a side wall 2 of a furniture carcass by a hinge arm 11. In this case, the hinge arm 11 is again not fixed directly to the furniture carcass, but by way of a mounting device 9 according to the invention.

The hinge 1 itself has the increased opening stroke movement already described hereinbefore, which in regard to the prevailing factors, by virtue of the thickness d of the furniture doors 3, 3*a*, is not sufficient to avoid collisions during the opening movement. A connecting element 6 is fixed to the intermediate portion 10 mounted moveably relative to the hinge arm 11 by the hinge lever 13, and the connecting element 6 in this embodiment is in the form of two-part lever comprising the lever arms 18*a* and 18*b* which are connected rotatably relative to each other by the spindle 19. The hinge levers 7*a*, 7*b* are rotatably connected to the connecting element 6 by the spindle 17. The hinge levers 7*a* and 7*b* are further mounted rotatably to the fixing device 5 by the spindle 20. Mounting lugs 21*a*, 21*b* arranged on the fixing device 5 serve for that purpose.

In addition, the hinge levers 7*a*, 7*b* are mounted rotatably to the base plate 8 by the spindle 22. Mounting lugs 23*a*, 23*b* are also arranged on the base plate 8 for that purpose. Also arranged on the fixing device 5 are further mounting lugs 24*a*, 24*b*, to which a respective further fixing device hinge lever 26*a*, 26*b* is mounted. The further hinge levers 26*a*, 26*b* are rotatably mounted at their other end to the base plate 8, further mounting lugs 25*a*, 25*b* being provided for that purpose on the base plate 8.

FIGS. 3*a*, 3*b*, 3*c* and 3*d* correspond to the time sequence of an opening movement of the hinge 1. As can be seen in particular from FIGS. 3*b* and 3*d*, the opening stroke movement which is already increased by the hinge is further increased by the mounting device 9 so that no collision between the adjacent furniture doors 3 and 3*a* occurs and the hinge 1 can be opened to its maximum opening angle, that is to say to its end position. The movement of the fixing device 5 relative to the base plate 8 can be particularly clearly seen by virtue of the movement of the mounting lugs 24*a*, 24*b* on the fixing device 5, relative to the mounting lugs 25*a*, 25*b* on the base plate 8.

Figure 4A:
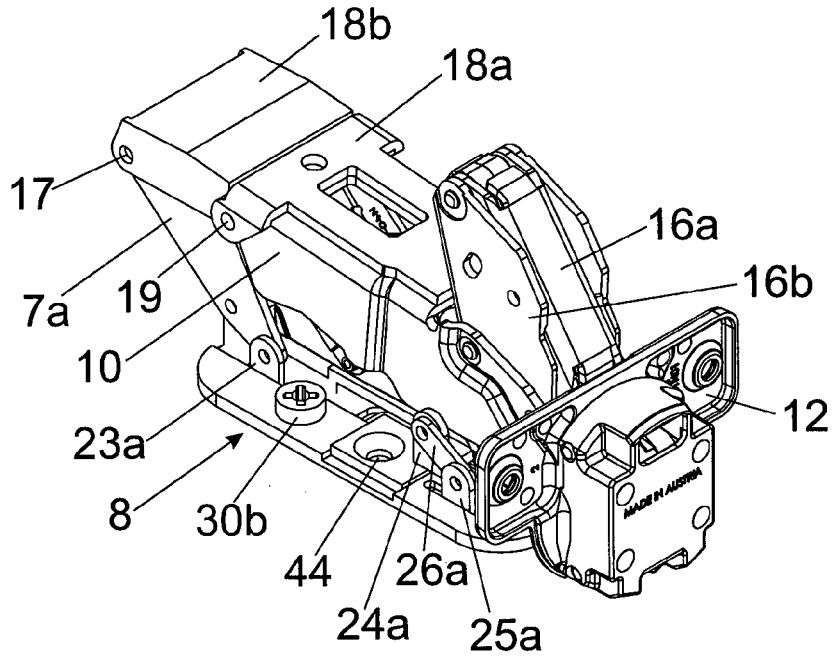
FIGS. 4*a* and 4*b* are perspective views of the first embodiment of the mounting device according to the invention with fixed wide-angle hinge in various open positions.

FIG. 4*a* shows the hinge 1 in the condition connected to the first embodiment of the mounting device 9 according to the invention, in its closed position. The connecting element 6 is in the form of a two-part lever comprising lever arms 18*a* and 18*b*. The lever arm 18*a* of the connecting element 6 has a partially plate-shaped configuration, and in the condition of being connected to the hinge 1 bears flat against the top side of the intermediate portion 10. The connecting element 6 has latching elements which are not visible in this Figure and which are in engagement with corresponding arresting or holding elements of the hinge 1 for fixing the connecting element 6. In that respect, one or both openings 42 shown in FIGS. 2*b* and 2*c* in the intermediate portion 10 can serve as the arresting elements, which openings 42 are in latching engagement with latching elements which are arranged on the connecting element 6 and which can have a resilient nature or be spring-loaded, and they can thus form a snap-action connection. Alternatively, however, it is also possible to provide for fixing with a screw or screws which can be fitted into holes 45 in the connecting element 6.

In addition thereto, the lever arm 18*a* has two tongues 28 which are hingedly connected to the second lever arm 18*b* and the hinge 1 by the spindle 19. In that arrangement, the tongues 28 can be clipped on to slightly projecting pin portions 27 of the hinge 1, thereby providing a simple and releasable snap-action connection.

Figure 4B:
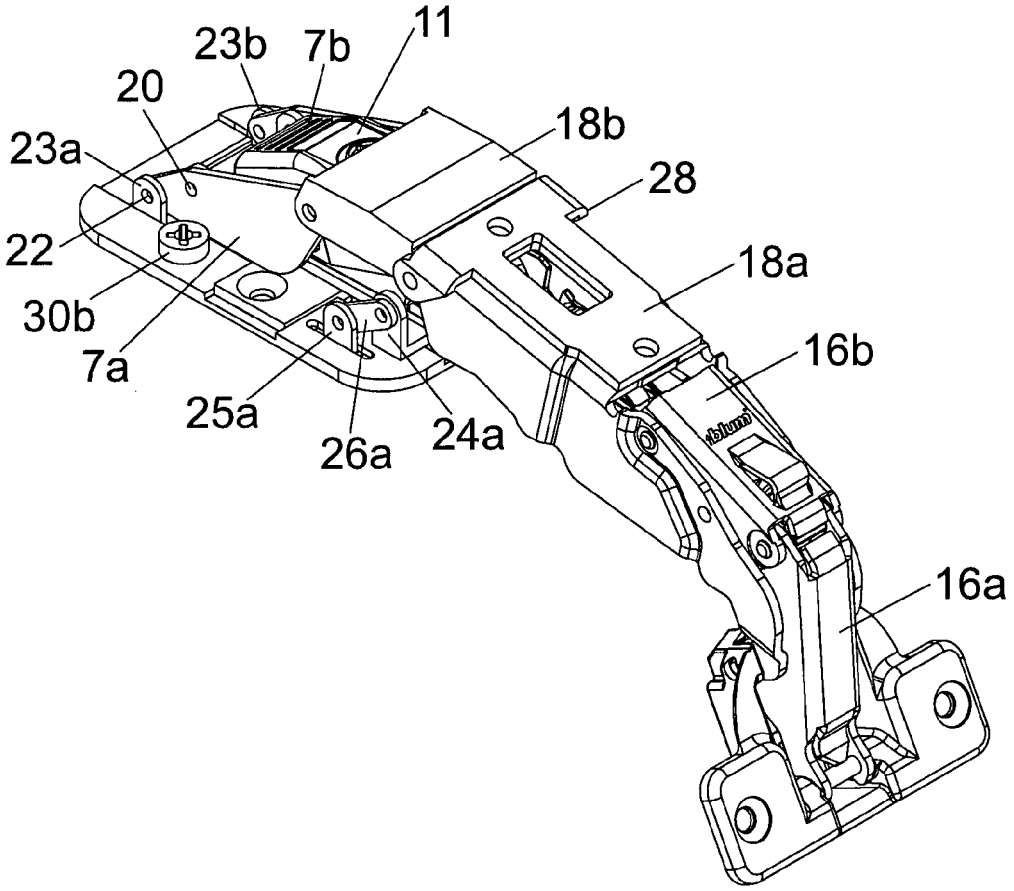

FIG. 4*b* shows the hinge 1 with mounting device 9 in the completely open position, utilizing the entire opening stroke movement of the hinge 1 and the mounting device 9.

Figure 5:
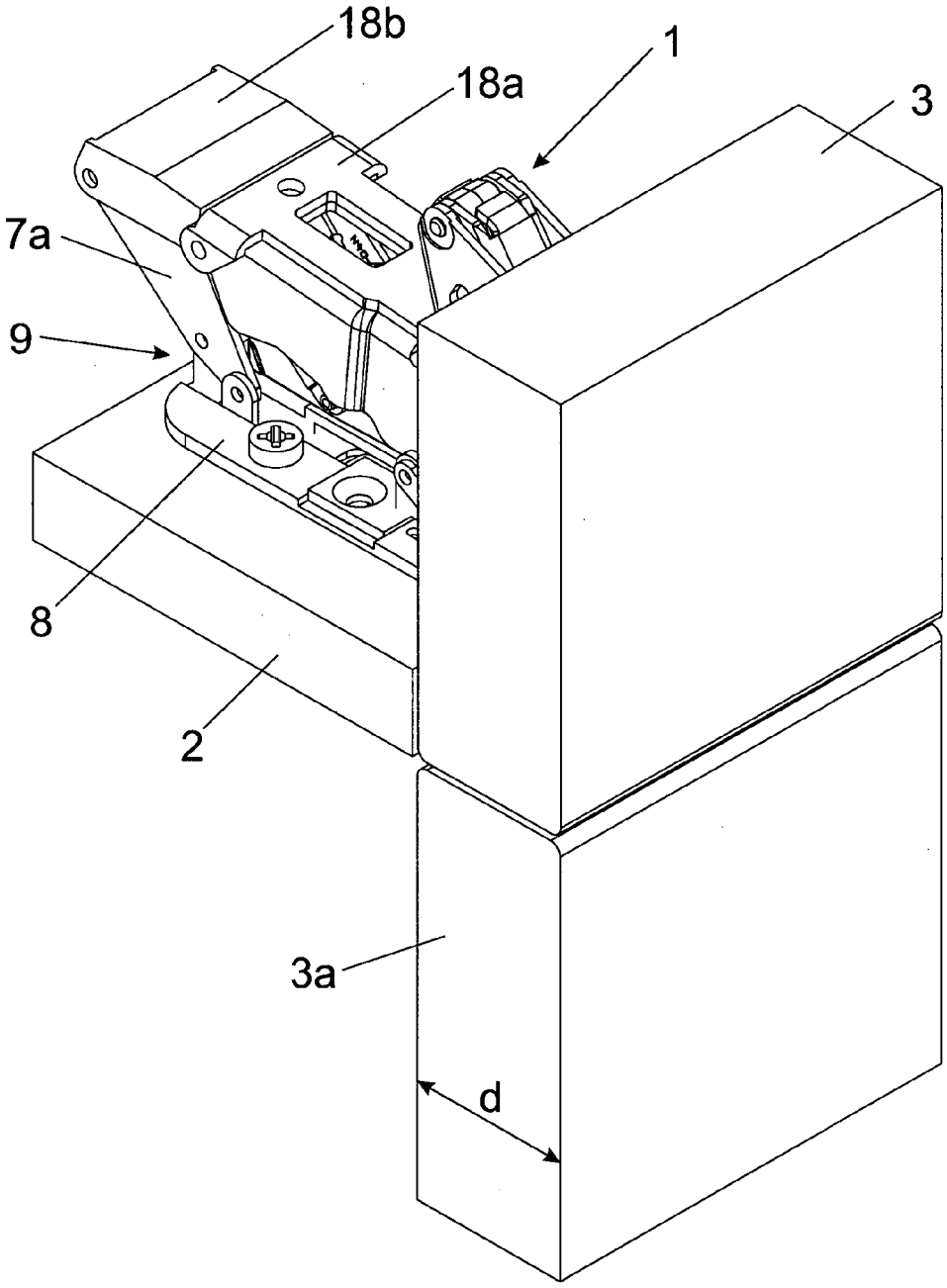
FIG. 5 shows a mounting device of the first embodiment, mounted to a furniture carcass, with fixed wide-angle hinge and furniture door fixed thereto in the closed position.

FIG. 5 shows a perspective view of the first embodiment of the mounting device 9, fixed to a side wall 2 of the furniture carcass. The hinge 1 which is in the closed position is connected to the side wall 2 by the mounting device 9 and to the furniture door 3*a* by the hinge cup 12.

Figure 6A:
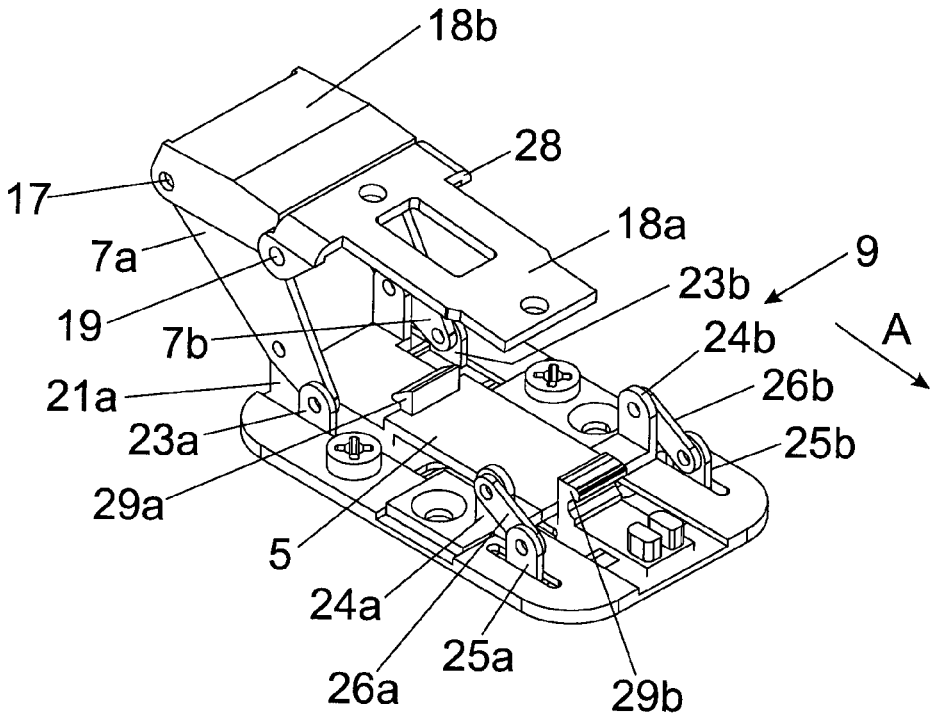
FIGS. 6*a* through 6*c* are perspective views of the first embodiment of the mounting device according to the invention in various operating positions and a related exploded view.
Figure 6B:
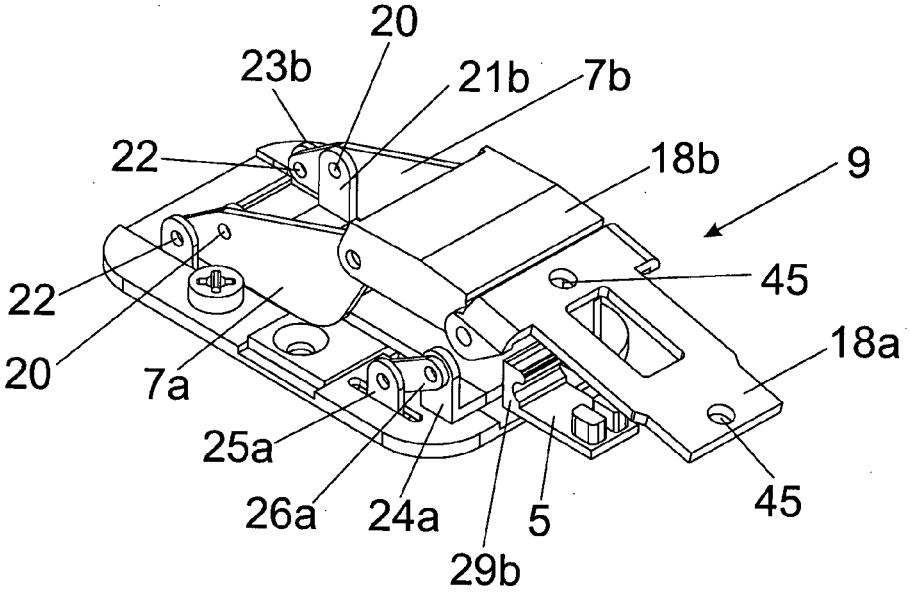

FIGS. 6*a* and 6*b* show the mounting device 9 without hinge 1 in the closed position (FIG. 6*a*) and in the open position (FIG. 6*b*). It can be seen that the fixing device 5 with the further hinge levers 26*a*, 26*b* forms a parallel lever assembly. The connecting element 6 can be fixed to the intermediate portion 10 which moves during the opening and closing movement of the hinge 1. The fixing device 5 is operated by base plate hinge levers 7*a*, 7*b*, in which case the fixing device 5 is moved relative to the base plate 8 by the movement of the connecting element 6, that is coupled to the hinge movement, during the opening and closing process of the hinge 1. In the opening movement the fixing device 5 moves in the direction of the arrow A relative to the base plate 8. The connecting element 6 is fixed to the hinge 1 by latching elements which are known in the state of the art and which are not visibly illustrated in FIGS. 6*a* through 6*c*, whereby the connecting element 6 can be clipped on to the intermediate portion 10.

The hinge arm 11 of the hinge 1 is clipped on to the fixing device 4, resilient latching elements 29*a*, 29*b* being provided for that purpose and engaging into corresponding arresting elements of the hinge arm. The hinge itself has a release device, by which the connection to the mounting device 9 can be released again.

When the furniture door 3 is opened, the fixing device 5 moves together with the hinge 1 and the furniture door 3*a* fixed thereto in an arc out of the furniture carcass and passes around the adjacent door 3*a*. That combination of stroke movement and linear movement can be particularly clearly seen in FIGS. 3*b* through 3*d*. In the end position shown in FIG. 6*b*, the mounting lugs 24*a*, 24*b* arranged on the fixing device 5 have been moved forwardly relative to the mounting lugs 25*a*, 25*b* on the base plate 8, in relation to the end position shown in FIG. 6*a*.

Figure 6C:
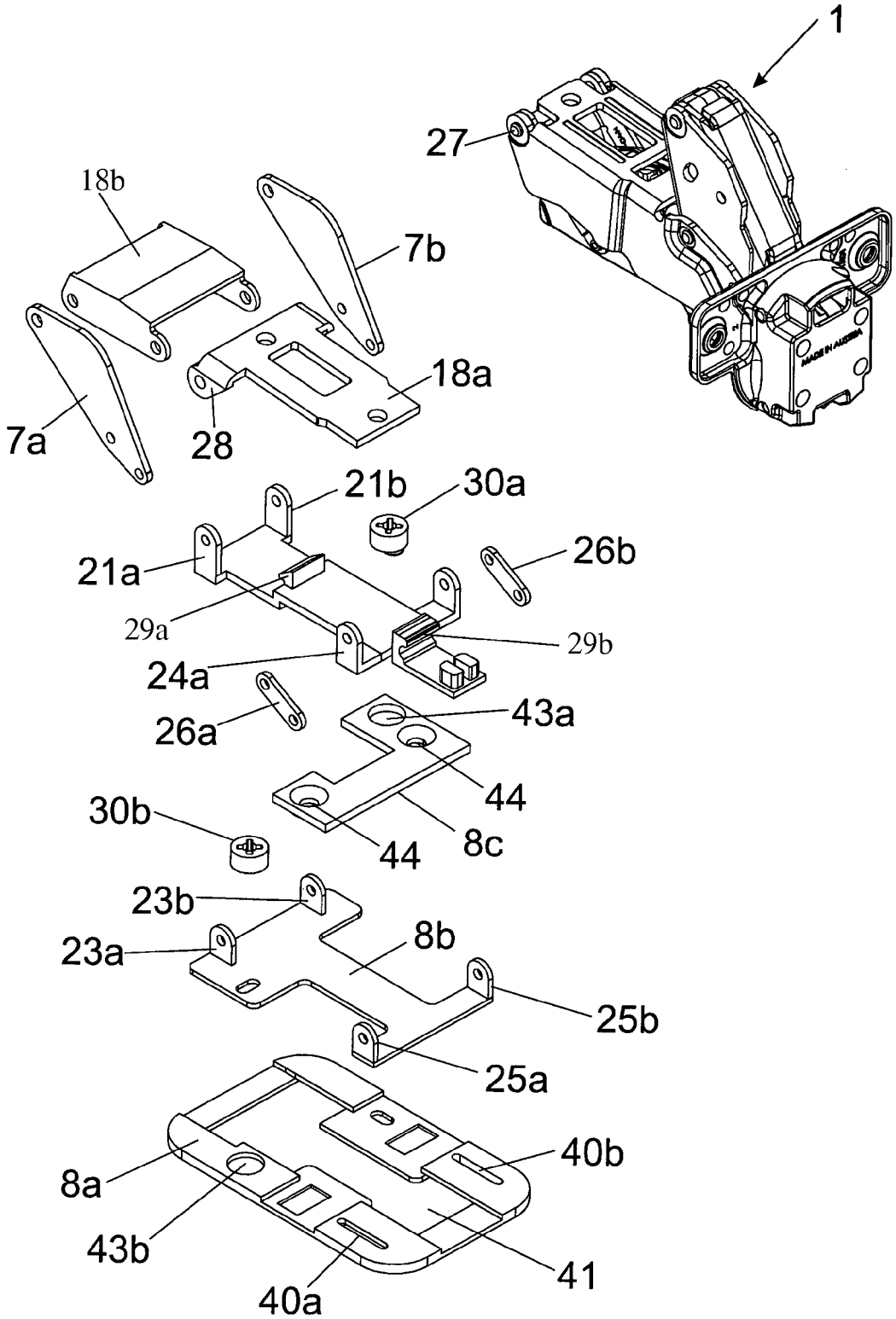
Figure 7A:
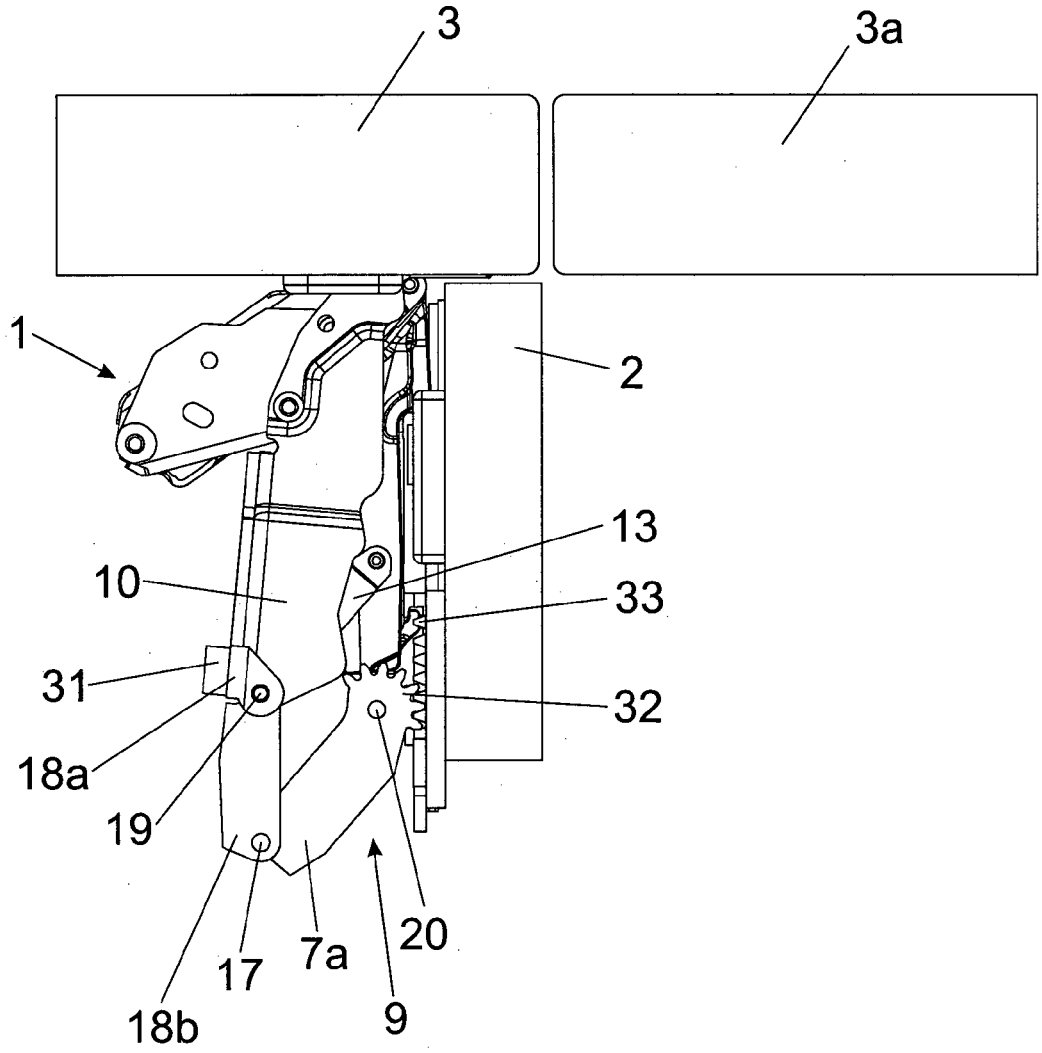
FIGS. 7*a* through 7*d* are plan views of a second embodiment of the mounting device according to the invention with fixed wide-angle hinge in various open positions.
Figure 7B:
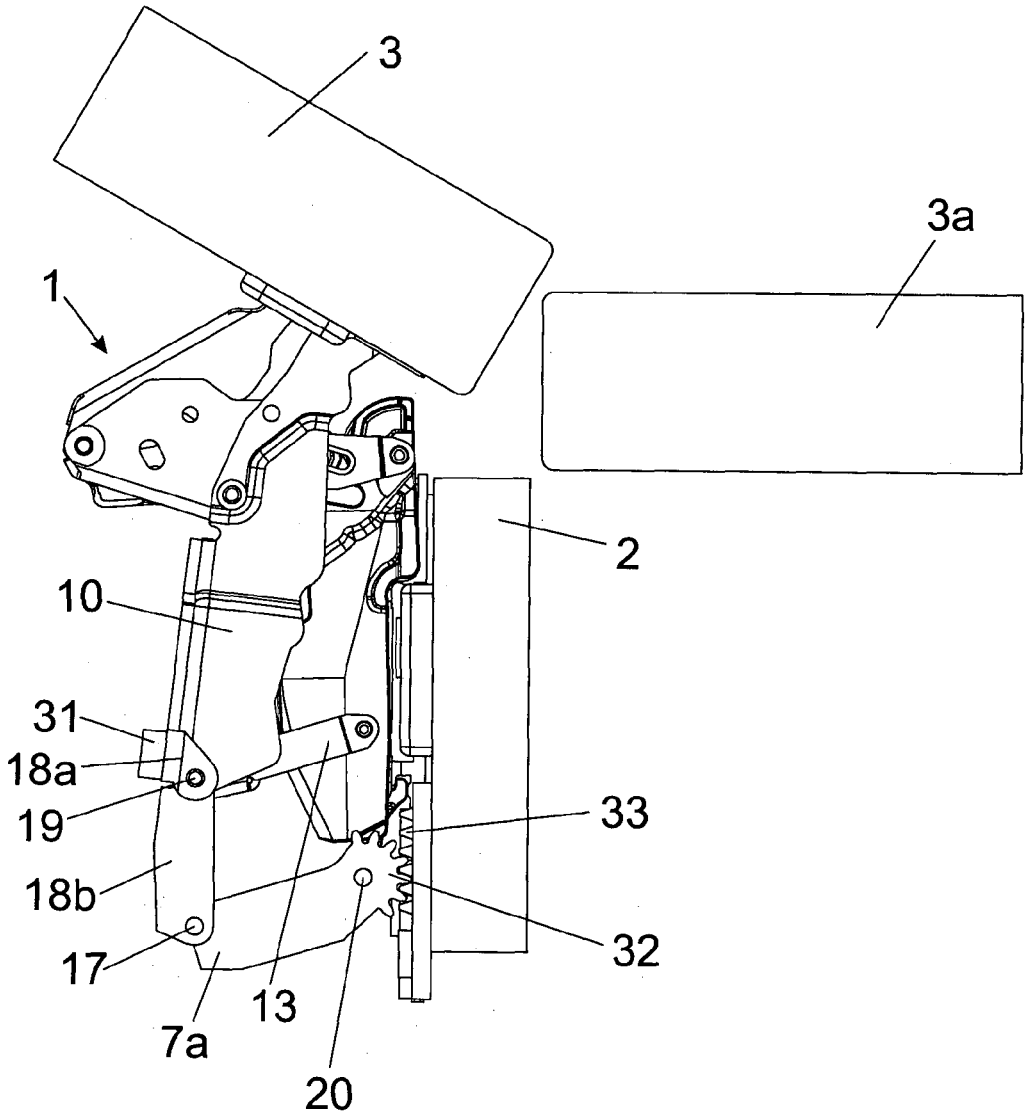
Figure 7C:
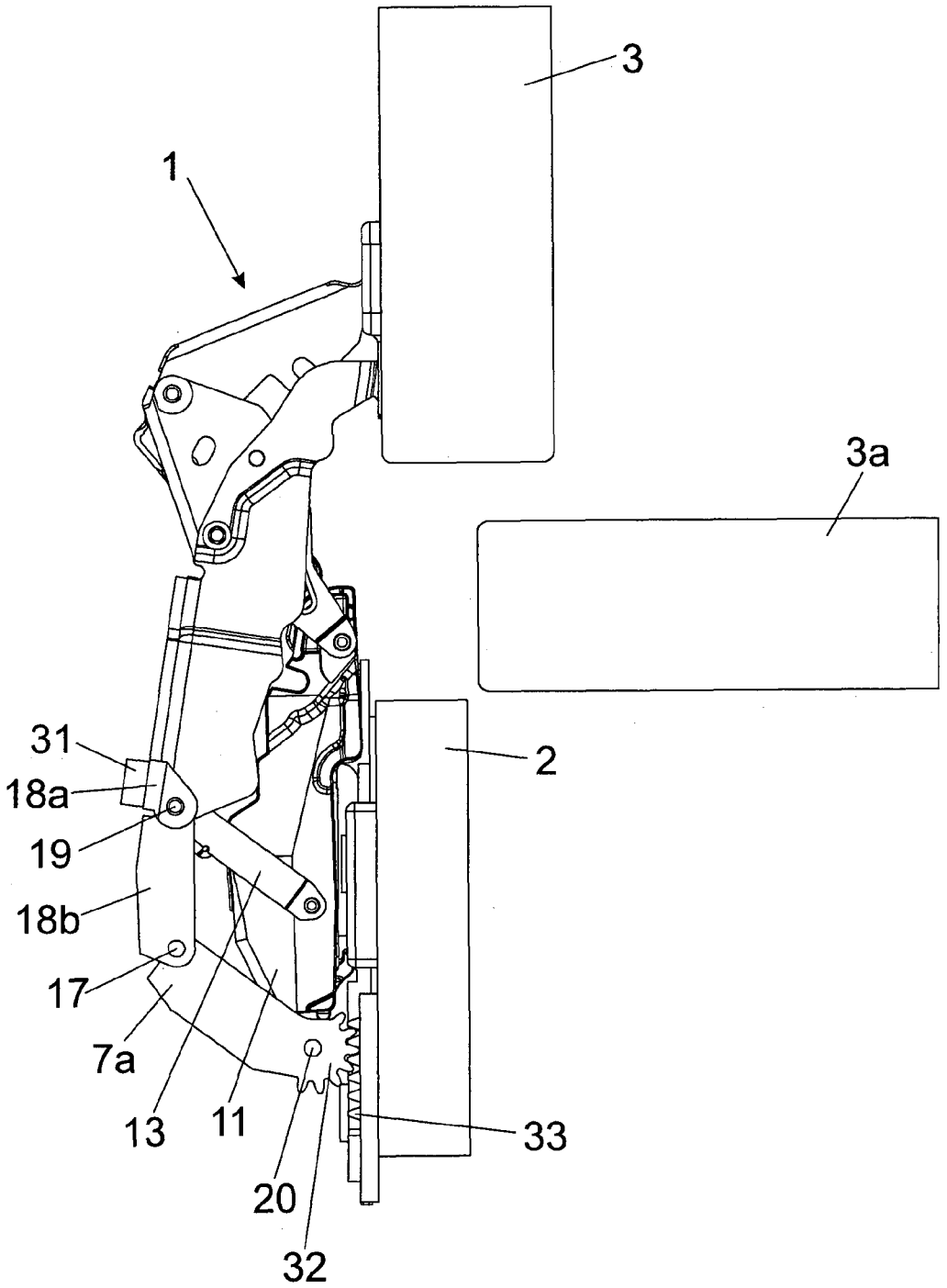
Figure 7D:
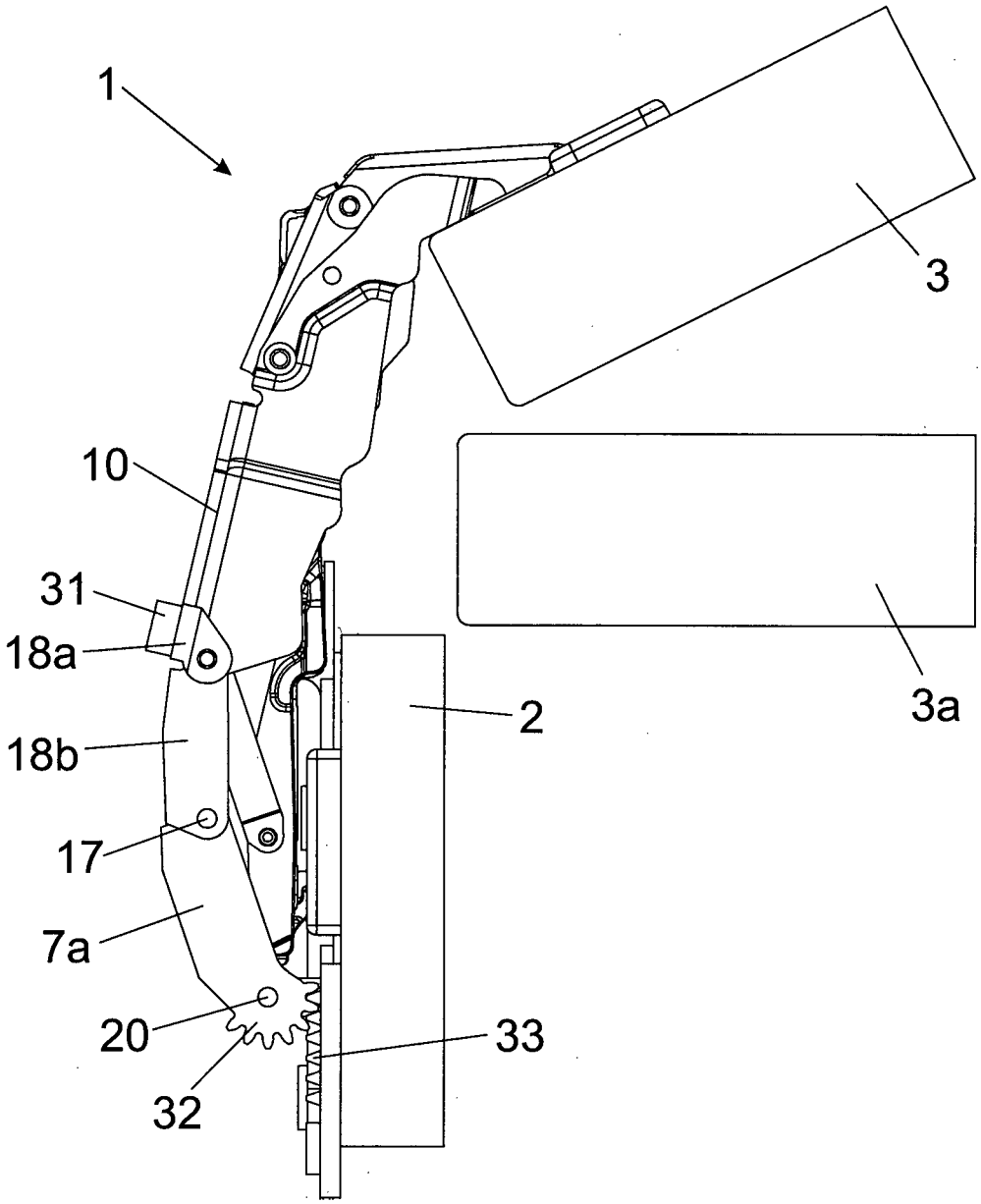

FIG. 6*c* shows an exploded view of the mounting device 9 and a perspective view of the hinge 1 to be fixed thereto. The base plate 8 comprises three plate-shaped elements 8*a*, 8*b*, 8*c* and is fixed to the furniture carcass with screws (not shown) which are fitted into holes 44 provided for same. The part 8*b* is fitted into openings 41 provided for same in the part 8*a* so that the base plate 8 is of a compact structural height. The part 8*c* is fitted under a bridge-shaped part of the fixing device 5. Relative mobility of the fixing device 5 is limited by the leg of the part 8*c*. The mounting lugs 25*a*, 25*b* are fitted into slot-shaped openings 40*a*, 40*b* in the base plate element 8*a*.

The base plate 8 has an adjusting element for adjustment in respect of height and depth. Eccentrics 30*a* and 30*b* which are fitted into openings 43*a* and 43*b* respectively serve that purpose.

FIGS. 7*a* through 7*d* show plan views of a time sequence of the opening movement of a hinge 1 fixed to a second embodiment of the mounting device 9 according to the invention. It is possible once again to see the opening stroke movement which is increased in relation to the hinge 1, whereby collisions with the adjacent furniture door 3*a* can be avoided. In this embodiment, the connecting element 6 is fixed to the intermediate portion 10 with a screw 31 fitted into one of the openings 45. The hinge levers 7*a* and 7*b* are again mounted rotatably to mounting lugs 21*a*, 21*b* of the fixing device 5 by way of a spindle 20.

In this embodiment of the mounting device, the hinge levers 7*a*, 7*b* are however not connected to the base plate 8 by way of a fixed joint but at their ends have a respective gear segment 32 meshing with a corresponding toothed bar 33 of the base plate 8. Consequently, the hinge levers 7*a*, 7*b* are not only rotated but also displaced with a translatory movement during the movement of the hinge 1 relative to the base plate, as can be clearly seen on the basis of the shift in position of the gear segment 32 relative to the toothed bar 33 in FIG. 7*a* through 7*d*.

Figure 8A:
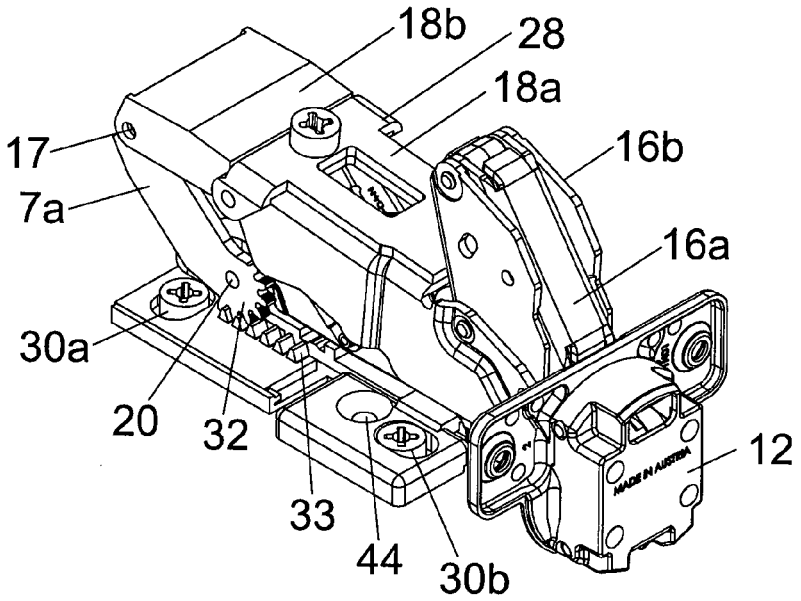
FIGS. 8*a* and 8*b* are perspective views of a second embodiment of the mounting device according to the invention with fixed wide-angle hinge in various open positions.

FIG. 8*a* shows the hinge 1 and the connected mounting device 9 in the closed position of the hinge 1. The gear segments 32 of the hinge levers 7*a*, 7*b* are arranged at the end of the toothed bars 33, that is at the inside of the carcass.

Figure 8B:
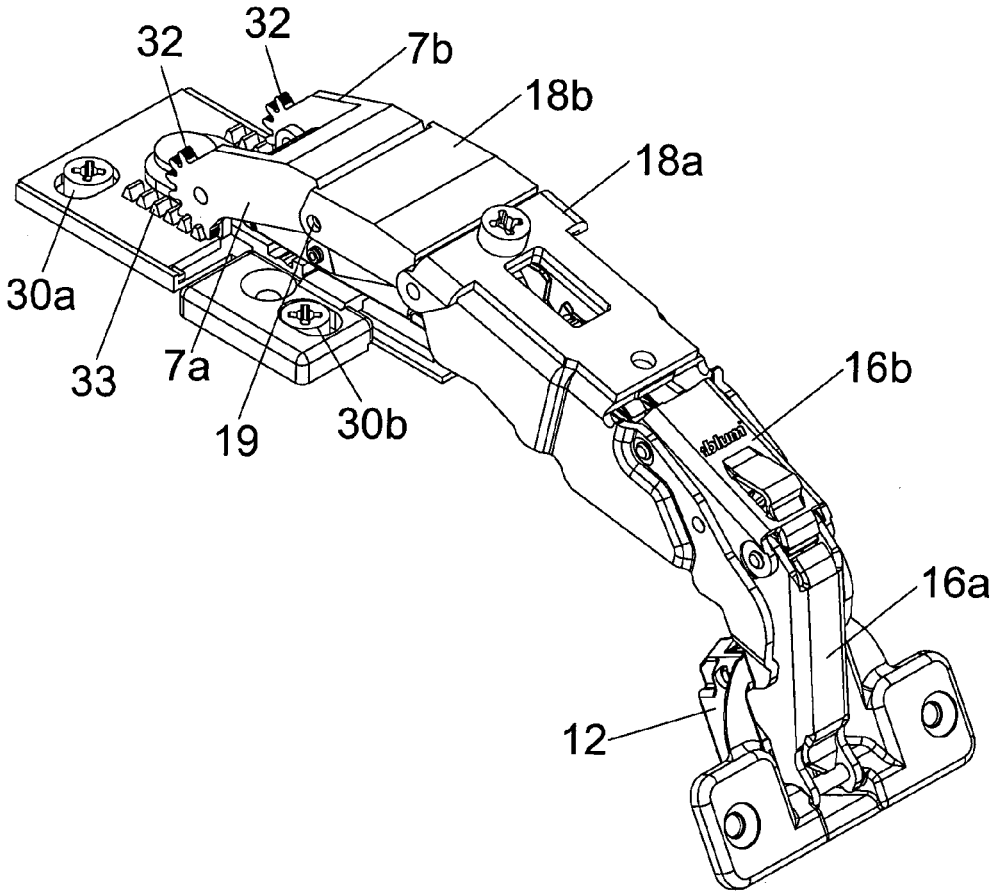

FIG. 8*b* shows the completely open position of the hinge 1 and of the mounting device 9. Now the gear segment 32 is arranged at the end of the toothed bar 33, that is at the outside of the carcass, this corresponding to the maximum mobility of the fixing device 5 relative to the base plate 8.

Figure 9:
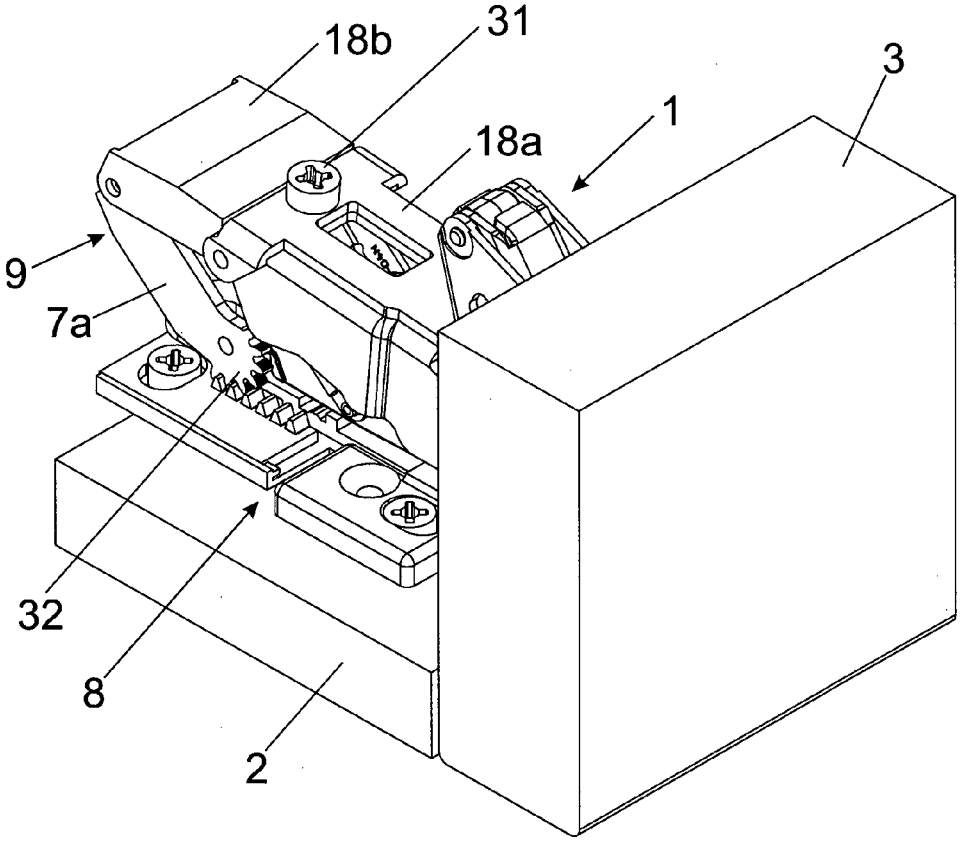
FIG. 9 shows a mounting device of the second embodiment, mounted to a furniture carcass, with fixed wide-angle hinge and furniture door fixed thereto in the closed position.

FIG. 9 shows the hinge 1 and the mounting device 9 of FIG. 8*a*, wherein the mounting device 9 is mounted to the side wall 2 of the furniture carcass and the hinge 1 is mounted with the hinge cup to the furniture door 3.

Figure 10A:
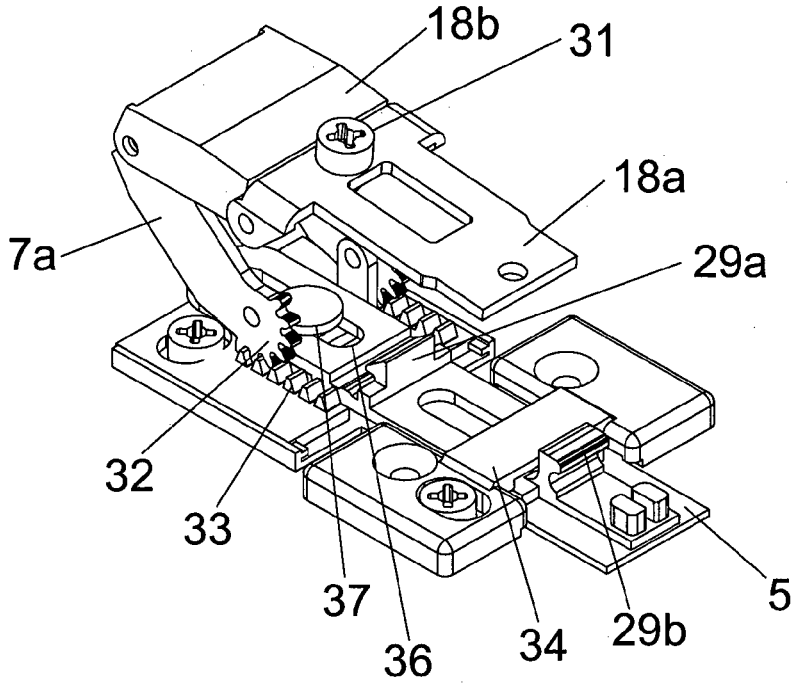
FIGS. 10*a* through 10*c* are perspective views of the second embodiment of the mounting device according to the invention in various operating positions and a related exploded view.

FIG. 10*a* shows a perspective view of the second embodiment of the mounting device 9. A part 8*c* of the base plate 8 has a bridge-like connection 34 over an opening 35, which serve as a guide device for the fixing device 5. Instead of the parallel lever assembly of the first embodiment the hinge lever 7*a* which is controlled by the gear segment has the advantage that the fixing device 5 is only moved linearly relative to the base plate 8 and does not require any additional stroke movement, as can also be seen from FIGS. 7*a* through 7*d*.

Figure 10B:
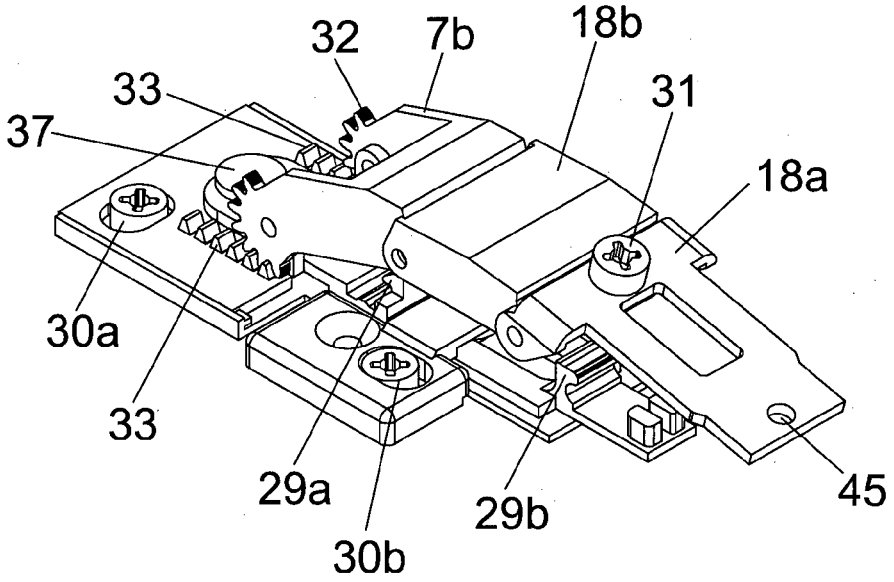

FIG. 10*b* shows a perspective view of the mounting device 9 in the completely open position, thereby affording the maximum additional opening stroke movement in relation to the opening stroke movement by the hinge 1.

Figure 10C:
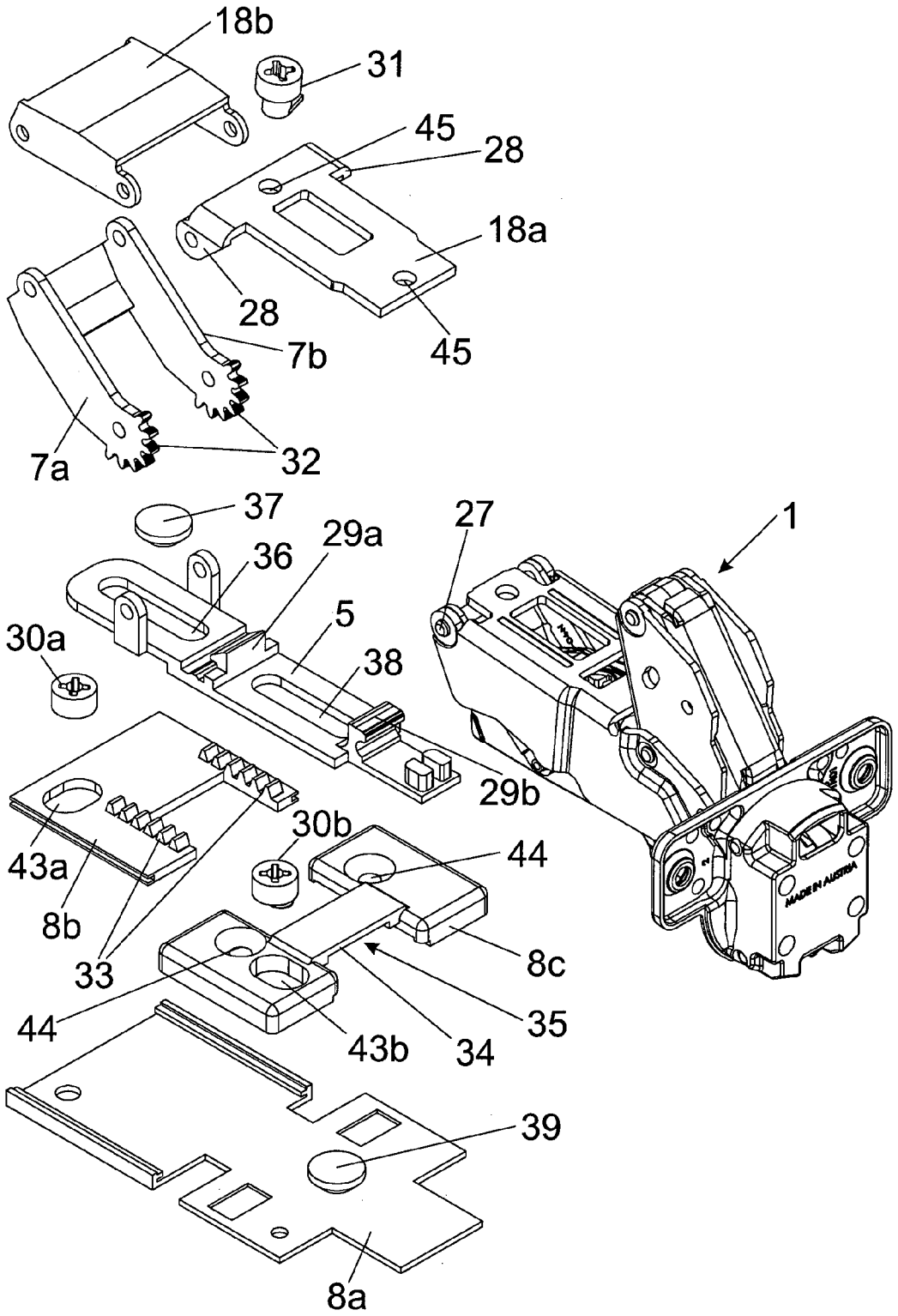

It can be seen from an exploded view of the mounting device 9 and a perspective view of the hinge 1 in FIG. 10*c* that the base plate 8 is again composed of three parts 8*a*, 8*b*, 8*c*. Adjustment in respect of height and depth of the base plate 8 fixed to the furniture carcass is possible by eccentrics 30*a* and 30*b* and the openings 43*a* and 43*b*. While in the first embodiment the further hinge levers 26*a*, 26*b* prevented the fixing device from lifting off the base plate 8, in this embodiment that purpose is served by the bridge-like connection 34 and a projecting pin portion 39 which can be fixed to the part 8*a* of the base plate 8 and which is displaceably guided in a slot-shaped opening 38 in the fixing device 5. The same purpose is served by a pin portion 37 which is fixed to the part 8*b* and which is displaceably mounted in the slot 36.

The invention claimed is:

1. A hinge arrangement comprising:

a furniture hinge including:

a hinge arm;

a hinge cup; and an intermediate portion mounted movably to said hinge arm, said intermediate portion being coupled to said hinge arm by at least two hinge arm levers and being coupled to said hinge cup by a hinge cup lever; and a mounting device for fixing said furniture hinge to a furniture carcass, said mounting device including:

a base plate configured to be fixed to a side wall of the furniture carcass;

a fixing device for connecting said hinge arm of said furniture hinge to said mounting device, said fixing device being mounted movably on said base plate; and a connecting element mounted movably to said base plate by a base plate hinge lever and connected to said intermediate portion of said furniture hinge, said fixing device being movable relative to said base plate by said base plate hinge lever.

2. The hinge arrangement as set forth in claim 1, wherein said hinge arm is releasably connected to said mounting device by said fixing device.

3. The hinge arrangement as set forth in claim 1, wherein said connecting element is connected to a top side of said intermediate portion.

4. The hinge arrangement as set forth in claim 1, wherein said hinge arm is clipped to said fixing device.

5. The hinge arrangement as set forth in claim 1, wherein said connecting element is clipped to the intermediate portion.

6. The hinge arrangement as set forth in claim 1, wherein said connecting element has a plate-shaped part at least partially embracing said intermediate portion.

7. The hinge arrangement as set forth in claim 1, wherein said connecting element is a two-part lever.

8. The hinge arrangement as set forth in claim 1, wherein said fixing device has a substantially plate-shaped configuration.

9. The hinge arrangement as set forth in claim 1, wherein said fixing device is pivotally connected to said hinge lever.

10. The hinge arrangement as set forth in claim 1, wherein said fixing device is mounted moveably to said base plate by a fixing device hinge lever.

11. The hinge arrangement as set forth in claim 1, wherein a mounting lug is arranged on said base plate, said hinge lever being rotatably mounted to said mounting lug.

12. The hinge arrangement as set forth in claim 1, wherein said base plate hinge lever is rotatably mounted to said base plate by one of a gear or a gear segment.

13. The hinge arrangement as set forth in claim 12, wherein a toothed bar is arranged on said base plate, said one of said gear or said gear segment meshing with said toothed bar.

14. The hinge arrangement as set forth in claim 1, wherein a guide device is arranged on said base plate for guiding a movement of said fixing device relative to said base plate.

15. The hinge arrangement as set forth in claim 1, wherein said fixing device has a substantially plate-shaped configuration.

16. The hinge arrangement as set forth in claim 1, wherein said base plate hinge lever and said connecting element are configured to fix said connecting element to said intermediate portion mounted moveably to said hinge arm and coupled to said hinge arm by said at least two hinge arm levers.

17. An article of furniture comprising:

a furniture carcass;

said hinge arrangement as set forth in claim 1; and a furniture door mounted pivotably to said furniture carcass by said hinge arrangement, said mounting device being mounted to said furniture carcass, and said furniture hinge being fixed to said mounting device for allowing opening and closing of said furniture door.

* * * * *